US009347193B2

(12) United States Patent
Pogorzelski

(10) Patent No.: US 9,347,193 B2
(45) Date of Patent: May 24, 2016

(54) SYSTEM FOR CHANGING ICE RESURFACER BLADES

(76) Inventor: Stanley Frank Pogorzelski, Simcoe (CA)

( * ) Notice: Subject to any disclaimer, the term of this patent is extended or adjusted under 35 U.S.C. 154(b) by 1145 days.

(21) Appl. No.: 13/296,688

(22) Filed: Nov. 15, 2011

(65) Prior Publication Data

US 2012/0124795 A1 May 24, 2012

Related U.S. Application Data

(63) Continuation-in-part of application No. 11/739,263, filed on Apr. 24, 2007, now abandoned.

(60) Provisional application No. 61/473,268, filed on Apr. 8, 2011.

(51) Int. Cl.
*E01H 4/02* (2006.01)

(52) U.S. Cl.
CPC ..... *E01H 4/023* (2013.01); *Y10T 29/53961* (2015.01)

(58) Field of Classification Search
CPC ..... B66F 3/24; B66F 5/04; B66F 7/04; B66F 7/065; B66F 7/085; B66F 9/04
See application file for complete search history.

(56) References Cited

U.S. PATENT DOCUMENTS

| | | | | |
|---|---|---|---|---|
| 4,690,250 | A * | 9/1987 | Bergstrom | 187/207 |
| 4,787,600 | A * | 11/1988 | Bode | 254/126 |
| 6,241,227 | B1 * | 6/2001 | Berdan et al. | 269/17 |
| 6,654,998 | B1 * | 12/2003 | Berdan et al. | 29/464 |
| 6,974,123 | B2 * | 12/2005 | Latvys | 254/122 |
| 2007/0277360 | A1 * | 12/2007 | Pogorzelski et al. | 29/281.1 |

* cited by examiner

*Primary Examiner* — Lee D Wilson
(74) *Attorney, Agent, or Firm* — Head, Johnson & Kachigian, P.C.

(57) ABSTRACT

A blade for an ice resurfacer having mounting holes is disclosed and has: one or more indexing holes; threaded sockets provided one for each mounting hole; and an operative position whereat each socket is contiguous with its hole. In use, a locating pin is threaded in a socket and received by the hole for said socket. Also provided is a tray, a jack and an indexing pin for each indexing hole. The tray holds the blade. Each indexing pin is received in use by its hole. The jack moves the tray between first and second positions associated with first and second configurations of the jack. In the first configuration, the assembly can move a loading position. In the second configuration, when the blade is held by the tray and the apparatus is in the loading position, the locating pins are received by mounting holes and the blade is operatively positioned.

16 Claims, 25 Drawing Sheets

SYSTEM FOR CHANGING ICE RESURFACER BLADES

CROSS-REFERENCE TO CO-PENDING APPLICATIONS

This application is a continuation-in-part of U.S. patent application Ser. No. 11/739,263 and claims priority on U.S. Provisional Patent Application Ser. No. 61/473,268, filed Apr. 8, 2011.

BACKGROUND OF THE INVENTION

1. Field of the Invention

This invention relates to devices or equipment for changing sharp blades such as the elongate, sharp blades of ice resurfacing machines.

2. Prior Art

Modern ice resurfacing machines, such as the machines sold by Frank J. Zamboni and Co. Inc. under the trade-mark ZAMBONI™, have been used in arenas both in Canada and the United States for many years. These machines employ a large, elongate steel blade that is mounted under the machine. The blade has a very sharp leading edge to scrape the ice surface. This sharp edge will become dull over time at which point the blade must be sharpened. Since sharpening involves removing material from the cutting edge, the width of the blade is reduced each time the blade is sharpened. Therefore, the blade will eventually have to be replaced following many instances of sharpening.

To lengthen the life of the blade, the blade is provided with two rows of threaded sockets. The holes of each of the rows of threaded sockets are disposed for alignment with holes of the blade receiver of an ice resurfacing machine for which the blade is intended to be mounted. The trailing row of threaded sockets, i.e. the row that is furthest from the cutting edge, is used when the blade has a width of less than 4", while the leading row of threaded sockets, i.e. the row closest to the cutting edge, is used when the blade has a width of 4-5".

Procedures for changing blades vary. One conventional procedure is to use a set of blocks. To install a sharp blade, the blade receiver of an ice resurfacing machine is raised and blocks are placed underneath the receiver. The sharp blade is removed from its sheath and placed on the blocks. The blade receiver is then lowered until it comes into contact with the blade. The position of the blade is then adjusted until the mounting holes of the blade align with the mounting holes of the blade receiver. Once aligned, the blade is secured to the receiver using a bolt and nut arrangement.

To remove a dull blade, the operation is performed in reverse. Of course, when removing a dull blade, no positioning of the blade is necessary. Another conventional procedure is to use a jack in a similar fashion. However, instead of lowering the blade receiver to a blade resting on the jack, the jack lifts a blade resting thereon to the blade receiver.

It will be appreciated that conventional procedures for changing blades are less than ideal. The risk that the blade will fall from the set of blocks or the lift jack, as the case may be, is considerable. Moreover, during installation of the sharpened blade, accurately positioning the blade under the blade receiver such that the threaded sockets align with the holes of the blade receiver can be difficult. Further, the described procedures are recommended to be performed with at least two persons and, even then, can take upwards of 45 minutes. Accordingly, changing the blade of an ice resurfacing machine not only presents certain risks to the handler or installer, but can be labour intensive and time consuming.

SUMMARY OF THE INVENTION

A blade changer apparatus for use with an ice resurfacing machine and a blade for said machine forms one aspect of the invention. This apparatus comprises a tray arrangement and a jack mechanism. The tray arrangement is for supporting at least said blade. The jack mechanism is adapted to move the tray arrangement between a lowered position and an elevated position whereat, when said blade is operatively supported by said tray arrangement and said jack mechanism is operatively positioned beneath said machine, said tray arrangement supports said blade substantially at an acute angle to a horizontally extending surface on which said apparatus rests and at a suitable height for securing said blade to said machine for use.

An improved blade for an ice resurfacing machine forms another aspect of the invention. The blade is of the type having a length and width and is bisected lengthwise into two equal halves by a reference line. The blade includes a cutting edge that extends the length of the blade and a plurality of pairs of threaded sockets. The socket pairs are spaced from each other along the width of the blade and the sockets of the socket pairs are spaced from each other along the length of the blade.

The improvement comprises two pairs of indexing holes arranged on either side of the reference line. The hole pairs are spaced from each other along the width of the blade and the holes of the hole pairs are spaced from each other along the length of the blade at a distance of about 48".

According to another aspect of the invention, the threaded sockets can be compatible with a Zamboni™ Model 525.

According to another aspect of the invention, the threaded sockets can be compatible with an Olympia™ Millennium (80").

According to another aspect of the invention, the threaded sockets can be compatible with an Olympia™ Millennium (84").

According to another aspect of the invention, the threaded sockets can be compatible with an ICECAT™ PRO220.

A sheath for use with the improved blade forms yet another aspect of the invention. The sheath has one or more indexing apertures extending therethrough. The indexing apertures are provided one for each of the indexing holes and each of the indexing apertures aligns with the indexing hole for which it is provided.

A blade changing system forms yet another aspect of the invention. This system, which is for an ice resurfacing machine having a blade receiver including one or more mounting holes, comprises a blade, one or more locating pins and a blade changing apparatus.

The blade has: a length; a width; one or more indexing holes defined therein; one or more threaded sockets defined therein and provided one for each of the mounting holes; a cutting edge extending the length of the blade; and an operative position whereat each threaded socket is substantially contiguous with the mounting hole for which it is provided, thereby permitting the blade to be mounted to the machine by threaded bolts.

The locating pins are provided for each of one or more of the threaded sockets. Each locating pin has a threaded first end and a second end, the first end engaging in use said each threaded socket and the second end being received in use by the mounting hole for which said each threaded socket was provided to index the blade to the blade receiver at the operative position.

The blade changing apparatus has a loading position and includes a tray arrangement and a jack mechanism.

The tray arrangement is adapted to operatively hold the blade and has one or more indexing pins provided one for each of the one or more indexing holes, each indexing pin being received in use by the indexing hole for which it is provided to index the blade to the tray arrangement when held thereby.

The jack mechanism is adapted to move the tray arrangement between a first position and a second position, the first position and second position of the tray arrangement being respectively associated with a first configuration and a second configuration of the jack mechanism.

In the first configuration, the apparatus is movable into the loading position from a position removed from the loading position.

In the second configuration, when the blade is indexed to the tray arrangement and the apparatus is in the loading position, the locating pins are received by the mounting holes and the blade is at the operative position.

According to yet another aspect of the invention, the locating pins and the mounting holes can be shaped such that when the blade changing apparatus is apart from the loading position, but within a predetermined range of positions including the loading position, and the jack mechanism is in the first configuration, moving the jack mechanism to the second configuration causes each locating pin to slide into the mounting hole provided for the threaded socket in which said each locating pin is engaged, thereby urging the blade to the operative position and the blade changing apparatus to the loading position.

According to yet another aspect of the invention, the shape of the second end of the locating pin can be selected from the group consisting of: pointed, rounded, spherical, beveled or chamfered.

According to yet another aspect of the invention, the mounting holes can be chamfered.

According to yet another aspect of the invention, the system can further comprise a sheath to which the blade is coupled for handing. The sheath has one or more indexing apertures defined therethrough. The indexing apertures are provided one for each of the indexing holes and each of the indexing apertures aligns with the indexing hole for which it is provided. The tray arrangement is further adapted to operatively hold blade when the sheath is coupled thereto.

According to yet another aspect of the invention, the tray arrangement can include an elongate upper surface having a length, a width, and opposite ends between which the upper surface extends in the lengthwise direction. The blade is held on the upper surface such that the length and width of the blade extend in the lengthwise and widthwise direction respectively of the upper surface.

According to yet another aspect of the invention, the width of the upper surface can be disposed at an acute angle to a horizontal surface on which the blade apparatus rests.

According to yet another aspect of the invention, the one or more indexing pins can comprise two indexing pins which project from the upper surface in a direction substantially normal thereto.

According to yet another aspect of the invention, the blade changing apparatus can further include a frame to which the jack mechanism is mounted, the frame having a plurality of wheels for rolling movement.

According to yet another aspect of the invention, the jack mechanism can comprise a first jack arrangement and a second jack arrangement both of which are configured in a manner similar to a floor jack and connected to the tray arrangement.

According to yet another aspect of the invention, the blade changing apparatus can be under the blade receiver in the loading position.

Advantages, features and characteristics of the blade changing system, as well as methods of operation and functions of the related elements of the structure, and the combination of parts and economies of manufacture, will become more apparent upon consideration of the following detailed description with reference to the accompanying drawings, the latter being briefly described hereinbelow.

DETAILED DESCRIPTION OF THE PREFERRED EMBODIMENTS

Figure 1:
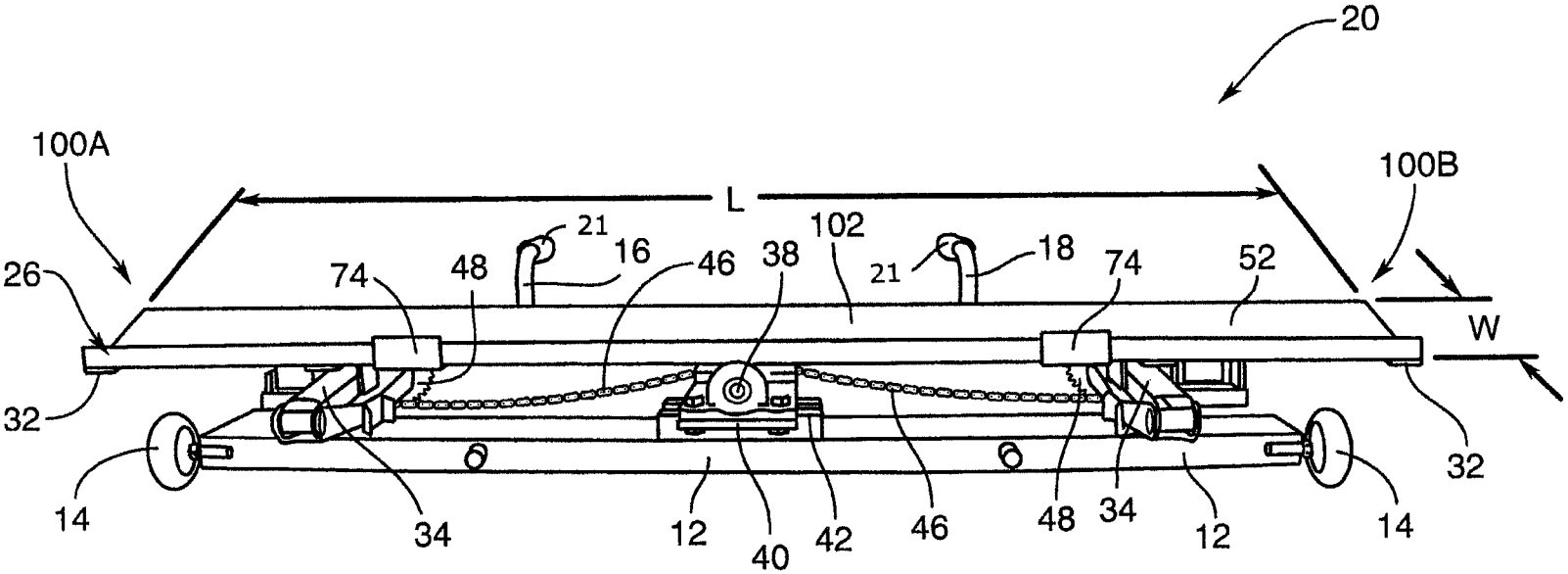
FIG. 1 is a front elevational view of a blade changer apparatus constructed according to an exemplary embodiment of the invention.
Figure 2:
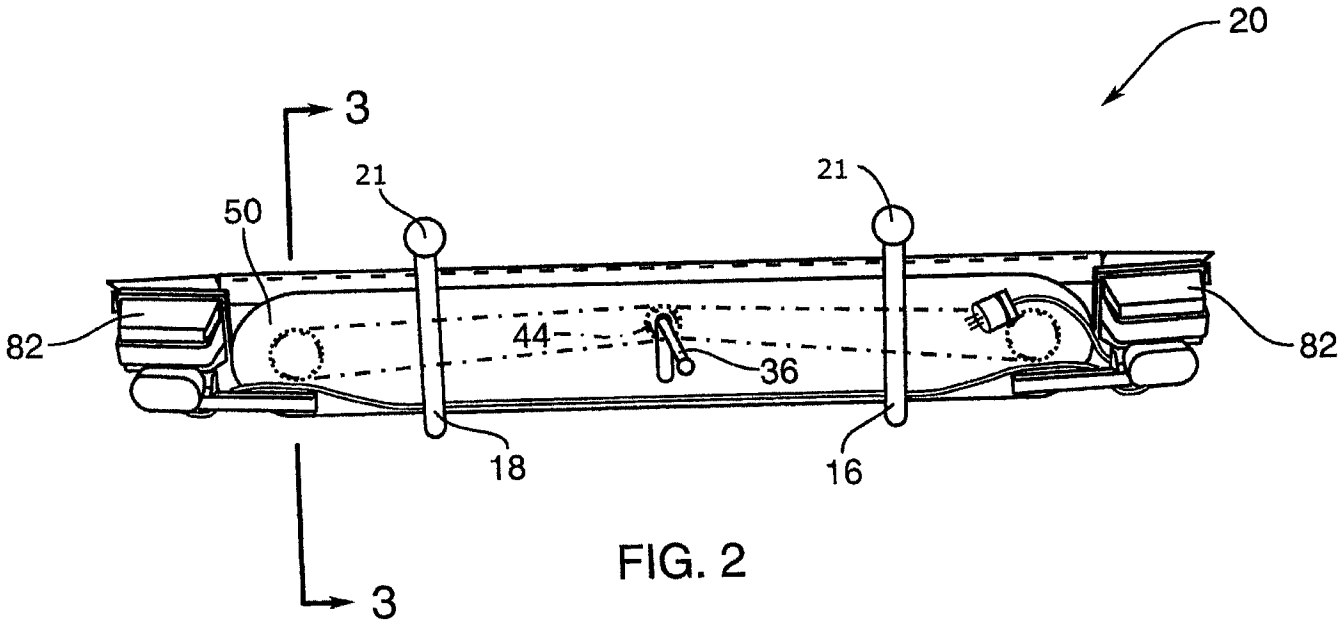
FIG. 2 is a rear elevational view of the structure of FIG. 1, with internal components shown in phantom outline.

With general reference to FIGS. 1-9, an exemplary embodiment of the present invention, a blade changer apparatus, is illustrated, and is designated by the general reference numeral 20. FIGS. 1 and 2 respectively show front and rear views of the blade changer apparatus 20. Visible in FIG. 1 is a base frame 12 in the form of a steel channel member that extends substantially the width of the blade changer apparatus 20. Mounted on opposite ends of the base frame 12 are two caster wheels 14 upon which the frame 12 can be rolled over a horizontal support surface or floor.

Figure 3:
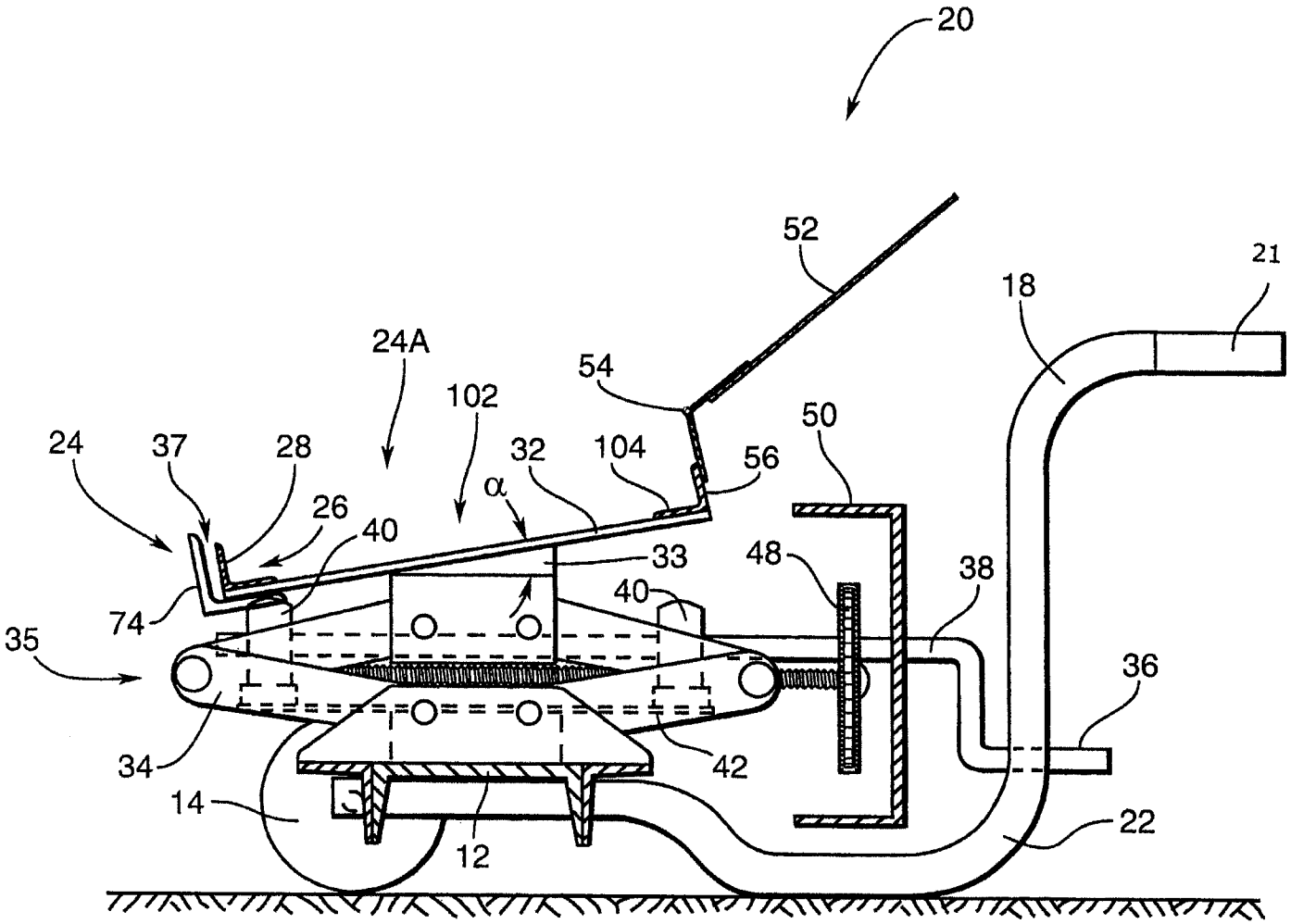
FIG. 3 is a view along section 3-3 of FIG. 2.

As seen in FIGS. 1-3, rigidly connected to the base frame 12 are two bent handle members 16 and 18 made from metal pipe and extending upwardly and rearwardly from the base frame 12. Mounted on each of these handle members 16, 18 is a rubber hand grip 21. The handle members include a lower bend 22 which forms a ground contact point when the blade changer apparatus 20 is not being moved.

Figure 4:
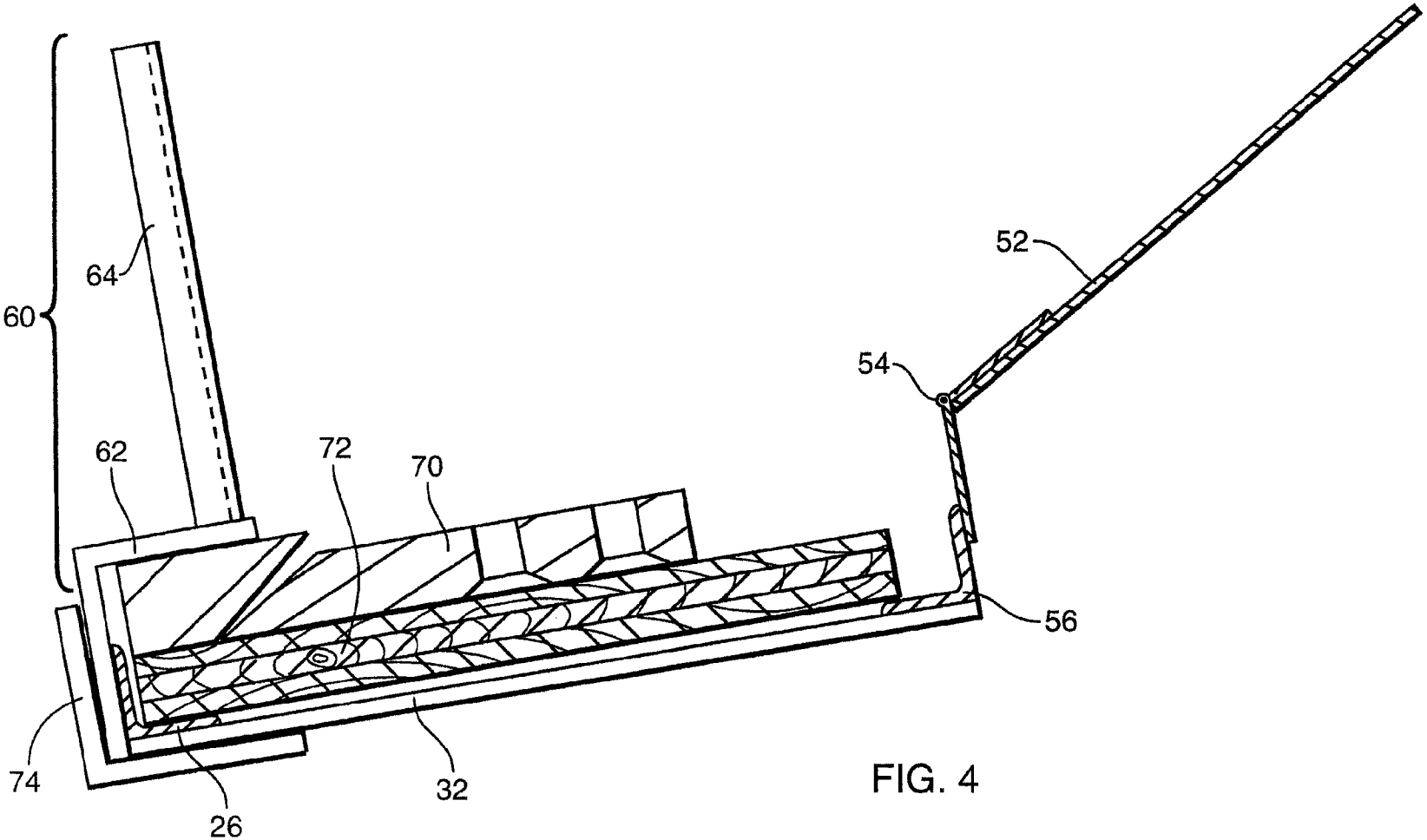
FIG. 4 is an enlarged view of a portion of FIG. 3, with a blade rest shown in a non-supporting position, a new or replacement blade with its protective sheath placed in the elongate tray of the blade changer and a stabilizer positioned with respect to the tray to form a guard.
Figure 5:
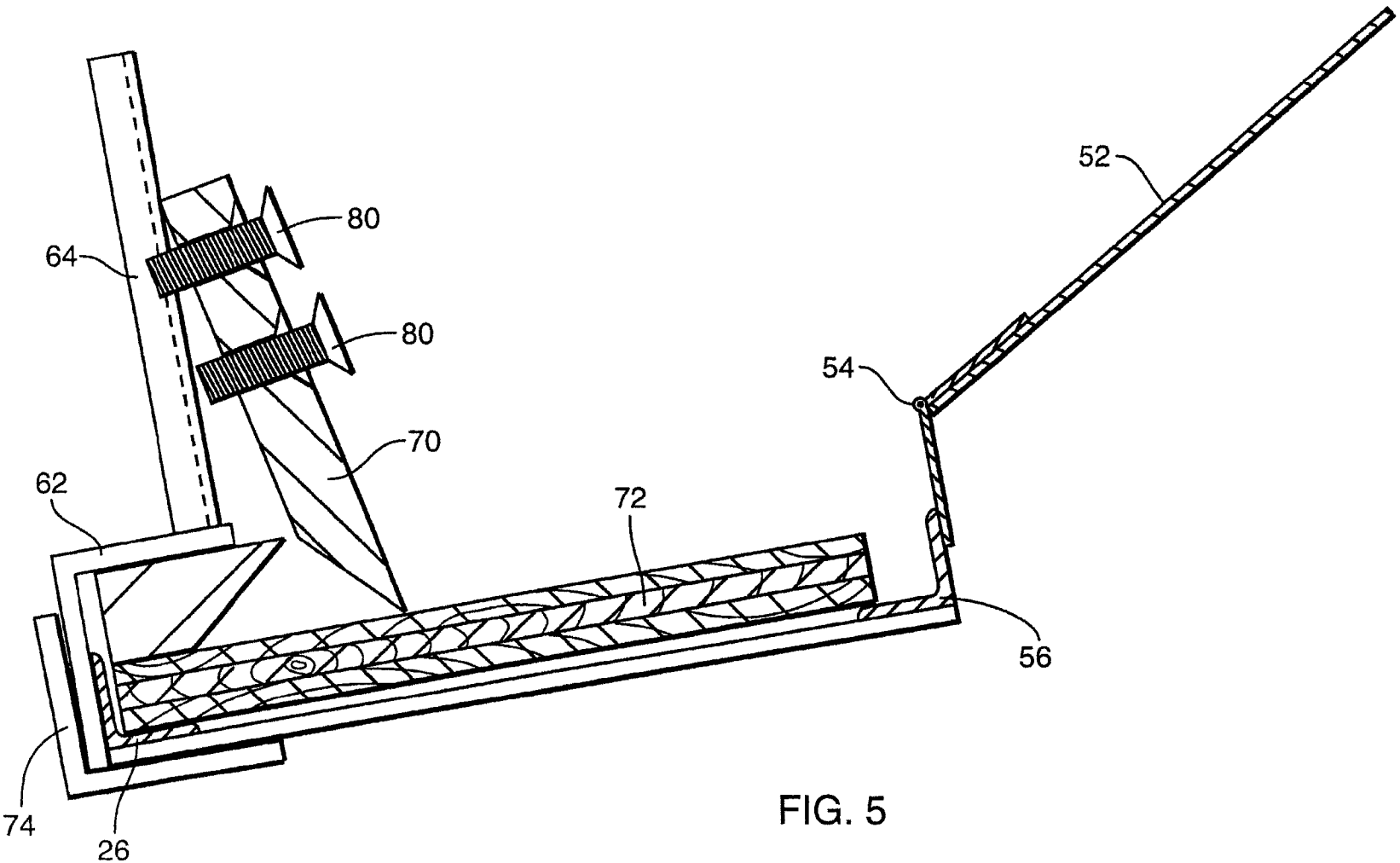
FIG. 5 is a view similar to FIG. 4, with the blade released from the sheath and disposed in an upright position against the guard, and with bolts fitted through corresponding holes formed in the blade.

As seen in FIGS. 1-3, the blade changer 20 includes an elongate tray arrangement 24. The tray arrangement 24 includes a blade/sheath holding section 102, an upper side 24A with a length and a width, opposite ends 100A, 100B between which said upper side 24A extends in a horizontal direction and a supporting surface 104 presenting upwardly. This tray arrangement 24 is formed in part by a front angle member 26 which, in a preferred embodiment, is five feet long. This angle member has an upstanding leg 28. The angle member 26 is welded to four horizontally-extending plate supports 32. Two of these plate supports 32 are located at opposite ends of the angle member 26 while the other two are positioned above and mounted on respective scissor jacks 34. As shown, a shim 33 is mounted between the top of each jack 34 and its respective support 32. Each shim 33 has a sloping top that orients the supporting surface 104 at an acute angle .alpha. to the horizontal support surface or floor. Angle .alpha. as shown is 10.degree. The scissor jacks 34 are mounted on top of the base frame 12 and together form part of a jack mechanism or arrangement 35. The scissor jacks 34 are jointly actuated by means of a centrally located crank handle 36 that is integrally connected to a horizontal shaft 38 which is rotated by a handle 36. The shaft 38 is rotatably supported by means of two bearing supports 40 mounted by means of bolts to a horizontal support plate 42. The plate 42 is rigidly mounted on top of base frame 12 at the center thereof. As best indicated by FIG. 2, there are mounted on shaft 38 two 12 tooth sprockets 44 which are arranged next to each other on the shaft 38. Extending from each of these sprockets 44 is an endless roller chain 46 with chain portions extending in each direction from the shaft 38, as seen in FIG. 1. Each endless chain 46 extends around a thirty tooth sprocket 48 so that in effect there is about a three to one gear ratio between the drive sprockets 44 and the driven sprockets 48, making rotation of the crank handle 36 relatively easy. Chain, drive sprocket and driven sprockets are shown in FIG. 2 in phantom outline, for greater clarity. It should be noted that, for clarity, only a single driven sprocket 48 and chain 46 are shown in each of FIGS. 3, 7, 8 and 9. As shown in FIG. 2, the chain and sprockets are covered by an elongate chain cover 50 for safety purposes. It will be understood that each sprocket 48 is operatively connected to its respective scissor jack 34 so that rotation of each sprocket 48 will actuate its respective jack. Because each sprocket 48 is operated by the same crank handle 36, the two jacks 34 will be actuated simultaneously. Connected to the rear side of the blade holding section 102 is a pivotable metal flap 52 which is pivotably mounted by means of a piano hinge 54. The piano hinge 54 is connected to the top edge of an upwardly extending leg of a rear angle member 56 which forms the rear side of the blade tray 24. The angle member 56 is rigidly connected (such as by welding) to the rear ends of the four plate supports 32. Another major component of the blade changer apparatus 20 is a stabilizer member 60 which can be completely detached from the rest of the blade changer 20. As seen in FIG. 4, the stabilizer 60 consists of a long angle member 62 and two short angle members 64 which extend perpendicular to the member 62.

To install a blade on an ice resurfacing machine, a sharp blade is procured. Such blades are typically shipped releasably secured to a protective sheath to form a blade/sheath combination, and the first step in such installation is to position said blade/sheath combination in the tray arrangement 24 as shown in FIG. 4, wherein the blade/sheath combination is supported by the tray arrangement, the blade being identified with reference numeral 70 and the two-part sheath by reference numeral 72.

Figure 6:
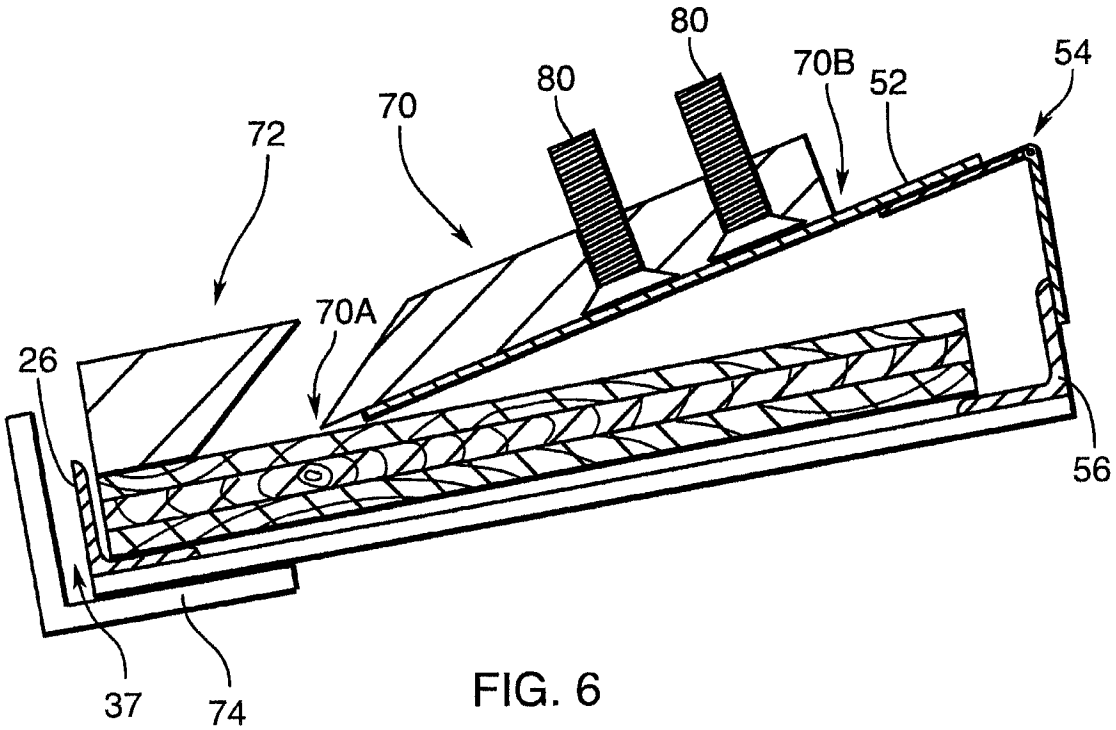
FIG. 6 is a view similar to FIG. 5, with the blade rest disposed in its supporting position and the blade resting thereupon.

This step may require the initial step of pivoting the flap 52 away from the top of the tray to a non-supporting position, and removal of the stabilizer 60, as indicated in FIG. 3, such that the combination 70/72 can be positioned in the tray 24. When placed in the tray 24, the sharp edge portion of the blade 70 is covered by the protective transportation sheath 72 which typically is made of wood. After the blade 70 has been placed on the tray 24, the stabilizer 60 can be mounted on the tray 24 using two metal support brackets 74 which are rigidly connected on the front side of tray 24. FIG. 4 shows the stabilizer 60 mounted on the tray 24 with the two short angle members 64 extending substantially vertically and the long angle member 62 fitted in a slot 37 (shown in FIG. 3) defined between leg 28 and brackets 74 to form a guard. Mounting bolts (not shown) which hold the protective sheath 72 and blade 70 together for handling are removed, these being located at opposite ends of the sheath 72. The blade 70 is then tipped forwardly against the guard, specifically, against the upright angle members 64 of the stabilizer 60, to the upright position shown in FIG. 5. Angle members 64 are appropriately sized and horizontally spaced-apart from one another, such that, so positioned, the blade can be safely rested. Pliers or other tools may be used for this manipulation. In this position, all of the blade mounting bolts 80 can be installed by inserting them through holes distributed along the length of the blade 70. Once the bolts 80 have been inserted, the metal flap 52 is swung down to its supporting position, onto the wooden sheath 72 which still extends horizontally. In this configuration, the top surface of the flap 52 extends at an angle to the horizontal of 15-30 degrees, corresponding to the correct mounting angle for the blade 70. The relatively heavy blade 70 with bolts 80 is then tipped back down onto the top of the metal flap 52 at which point the stabilizer 60 can be removed. The blade 70 so positioned on the flap 52 is shown in FIG. 6.

So positioned, the blade 70 is arranged on the upper side 24A of the tray arrangement 24 so that the length of the blade 70 extends in the lengthwise direction of the tray arrangement 24, and so that the blade 70, from front 70A to rear 70B edges thereof, extends at an acute angle to the horizontal surface on which the apparatus sits, said angle typically being between 15 and 30 degrees.

Figure 7:
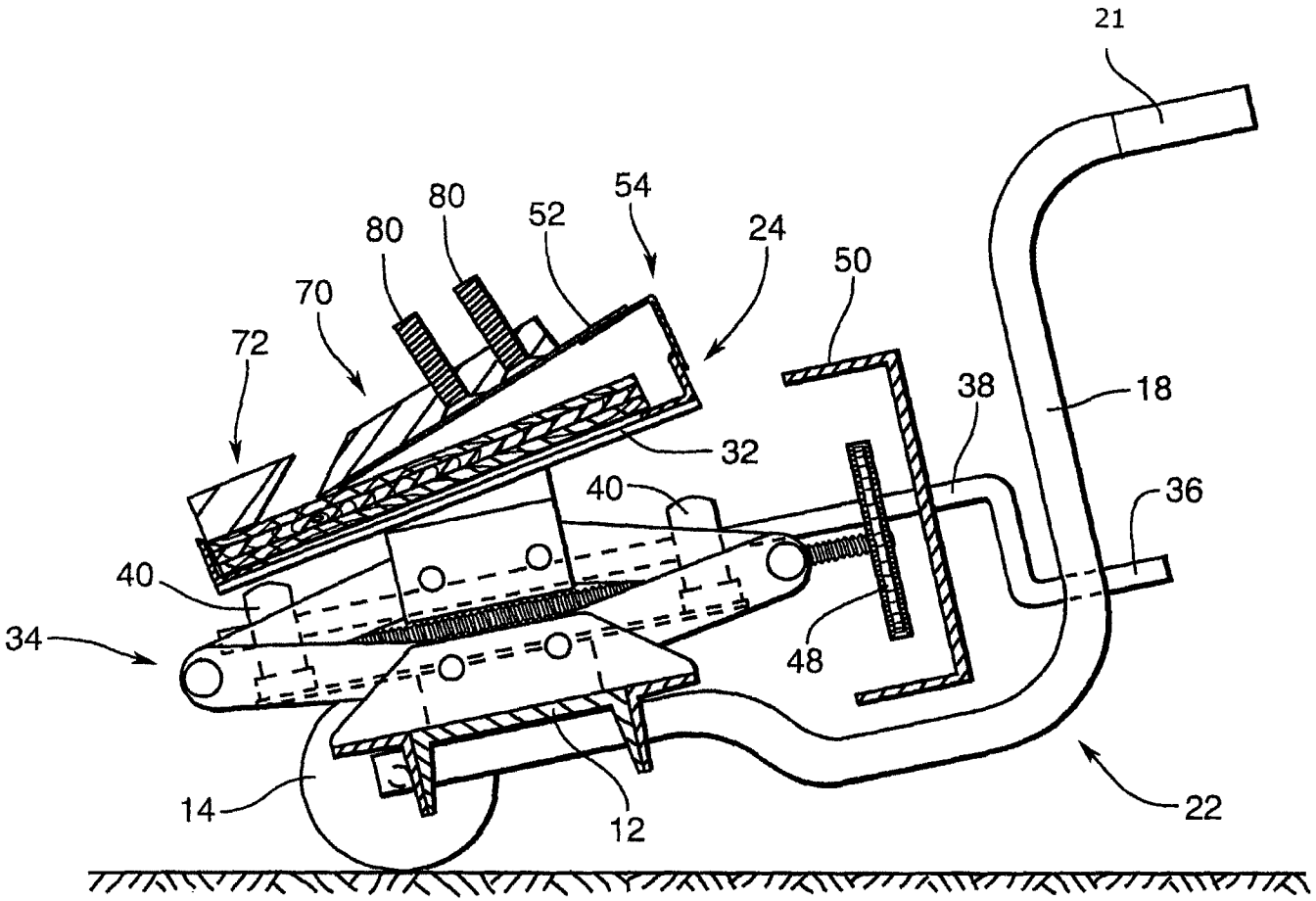
FIG. 7 is a view similar to FIG. 3, with the blade shown as in FIG. 6 and the rear end of the apparatus raised off the ground for transport.
Figure 8:
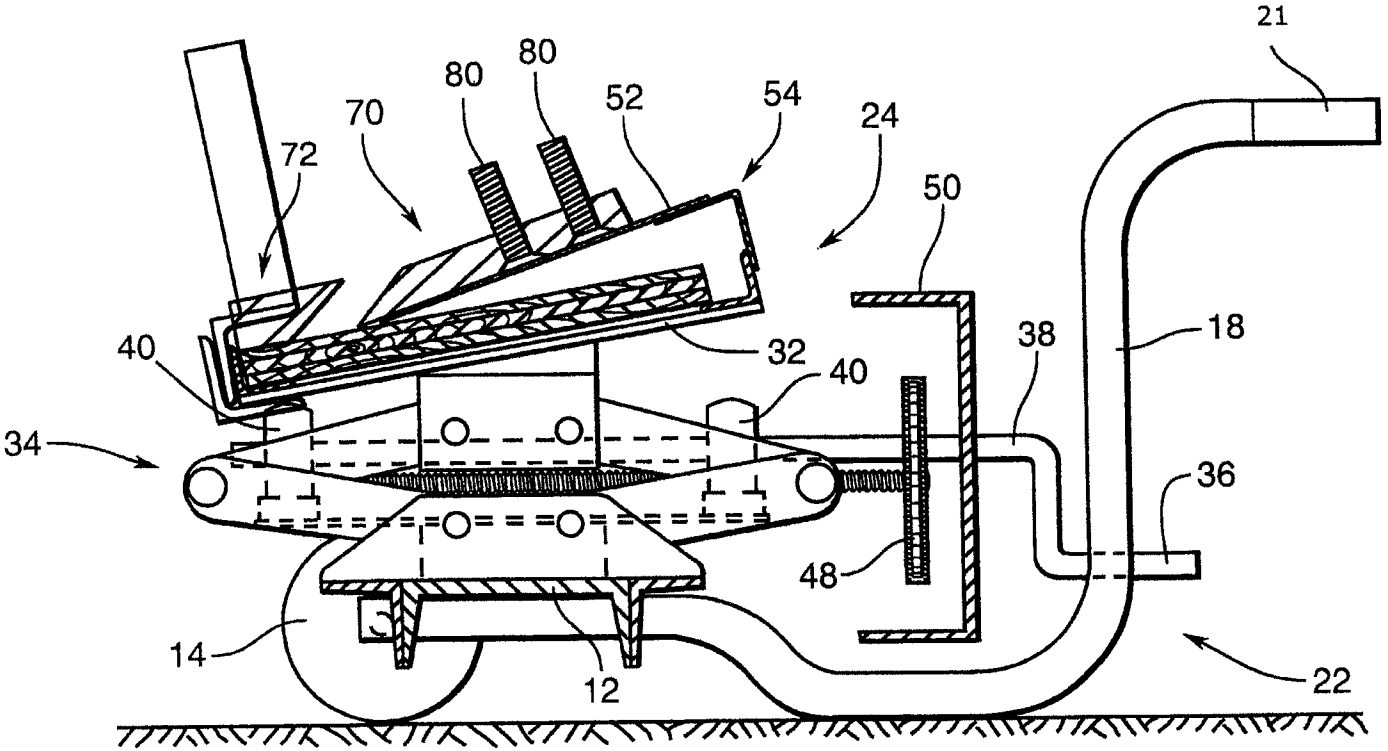
FIG. 8 is a view similar to FIG. 7, with the jack mechanism shown in its operative position and the tray shown in its lowered position.
Figure 9:
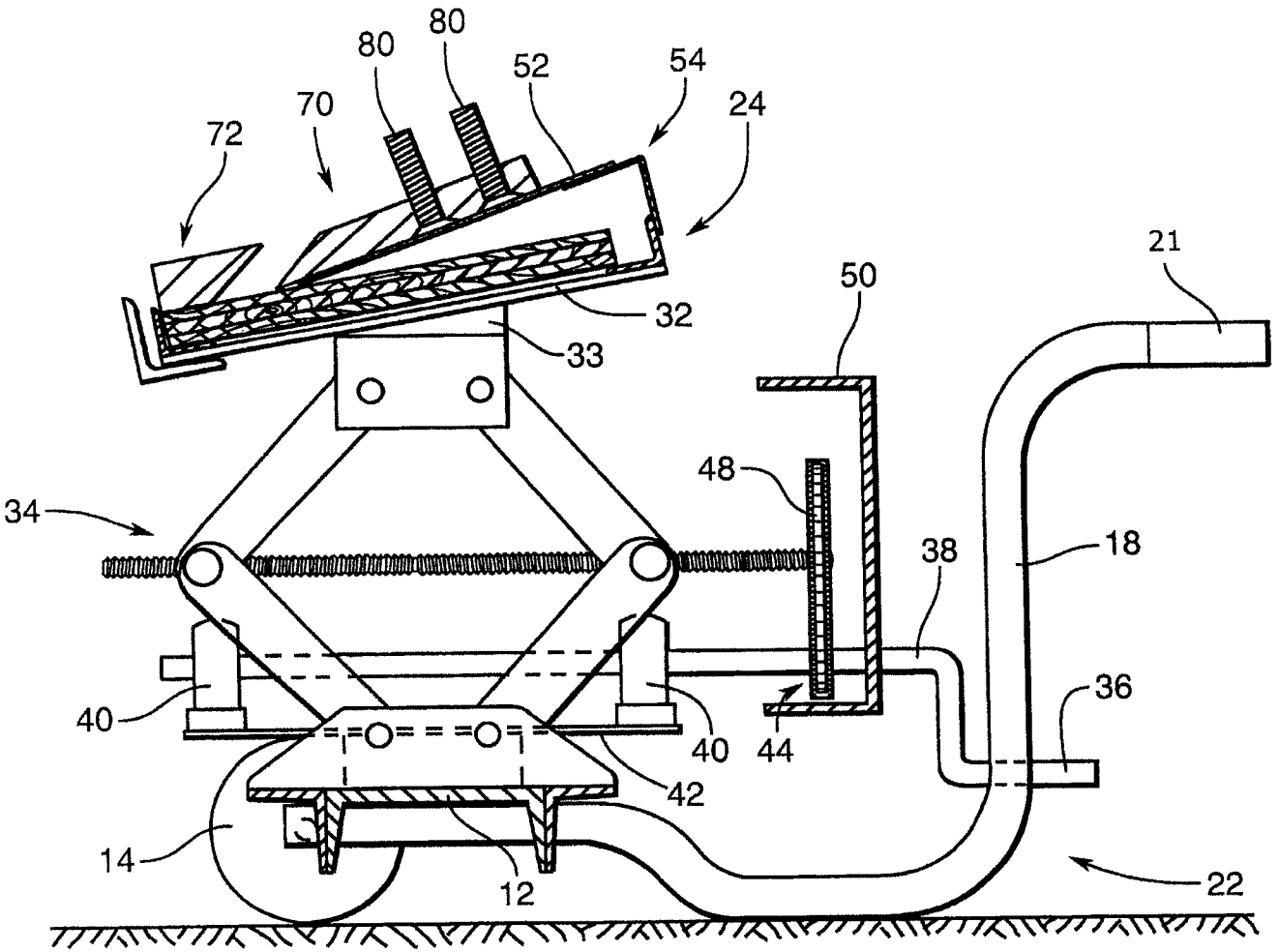
FIG. 9 is a view similar to FIG. 8, with the tray shown in its elevated position.

The next step is for the operator to roll the blade changer 20 with the blade 70 thereon under the ice resurfacing machine (not shown). The handles 16,18 can be gripped, and the apparatus 20 moved in the manner of a wheelbarrow for this purpose, as shown in FIG. 7. Thereafter, the crank handle 36 can be turned to actuate the jacks 34 and move the tray arrangement 24, and the blade 70 and sheath 72 supported thereby, upwards. In the operative position of the apparatus 20, the bolts 80 in the blade 70 line up with the mounting holes in the ice surfacing machine as the jack mechanism 35 lifts the tray 24 to its elevated position, such that at the elevated position of the tray 24, the blade 70 is fitted tightly against the mounting bar of the machine, with the mounting bolts 80 extending therethrough. That is, the blade 70 is supported at an acute angle to the horizontal surface on which the apparatus 20 rests and at a suitable height for securing the blade 70 to the machine for use. Lock washers and nuts (not shown) can then be used to connect the blade 70 to the ice conditioning machine. The tray arrangement 24 carrying the now-empty transportation sheath 72 is then lowered to its lowered position by reverse rotation of the crank handle 36, such that the blade changer apparatus 20 can be easily pulled away from beneath the ice conditioning machine. Lamps 82, shown in FIG. 2, which are mounted to the base 12, facilitate mounting and demounting of the blade 70.

The above procedure in reverse can be used to remove a blade from a machine.

Figure 10:
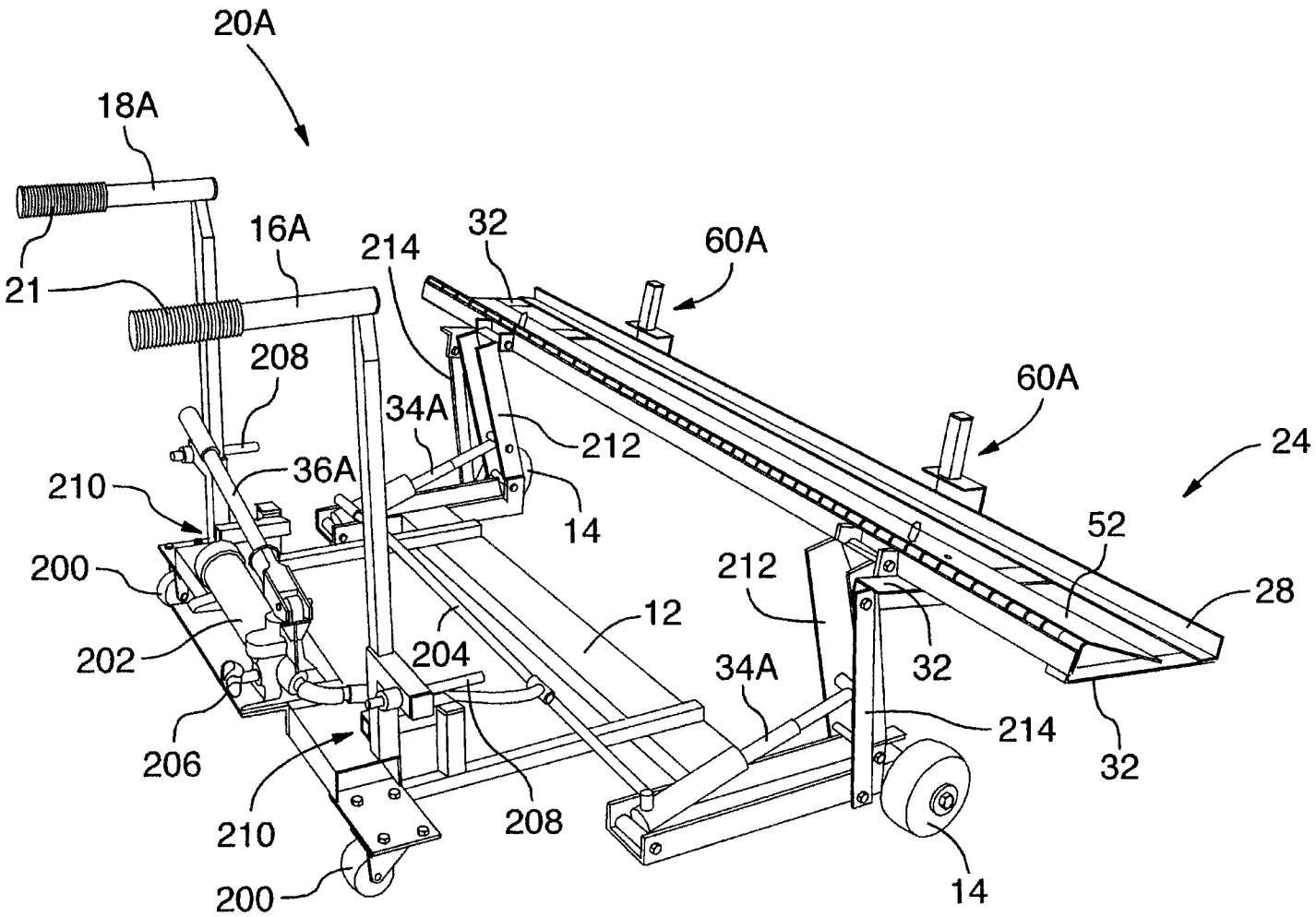
FIG. 10 is a rear perspective view of a blade changer apparatus according to another embodiment of the invention, with the tray thereof shown at its elevated position, with the blade rest disposed in its supporting position and with the handles thereof disposed at upper operative positions.
Figure 11:
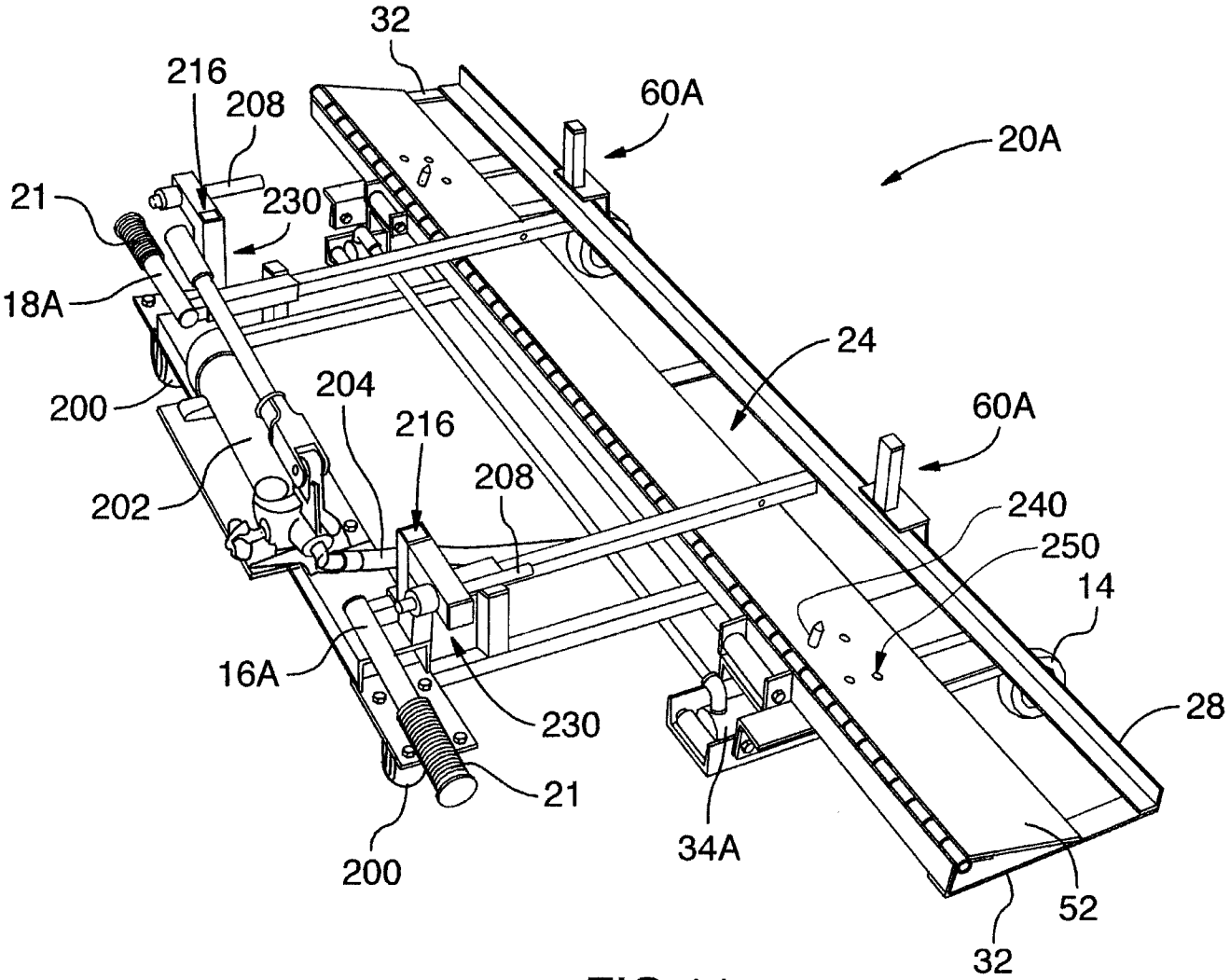
FIG. 11 is a rear perspective view of the apparatus of FIG. 10, with the tray shown at its lowered position and the handles disposed at storage positions.
Figure 12:
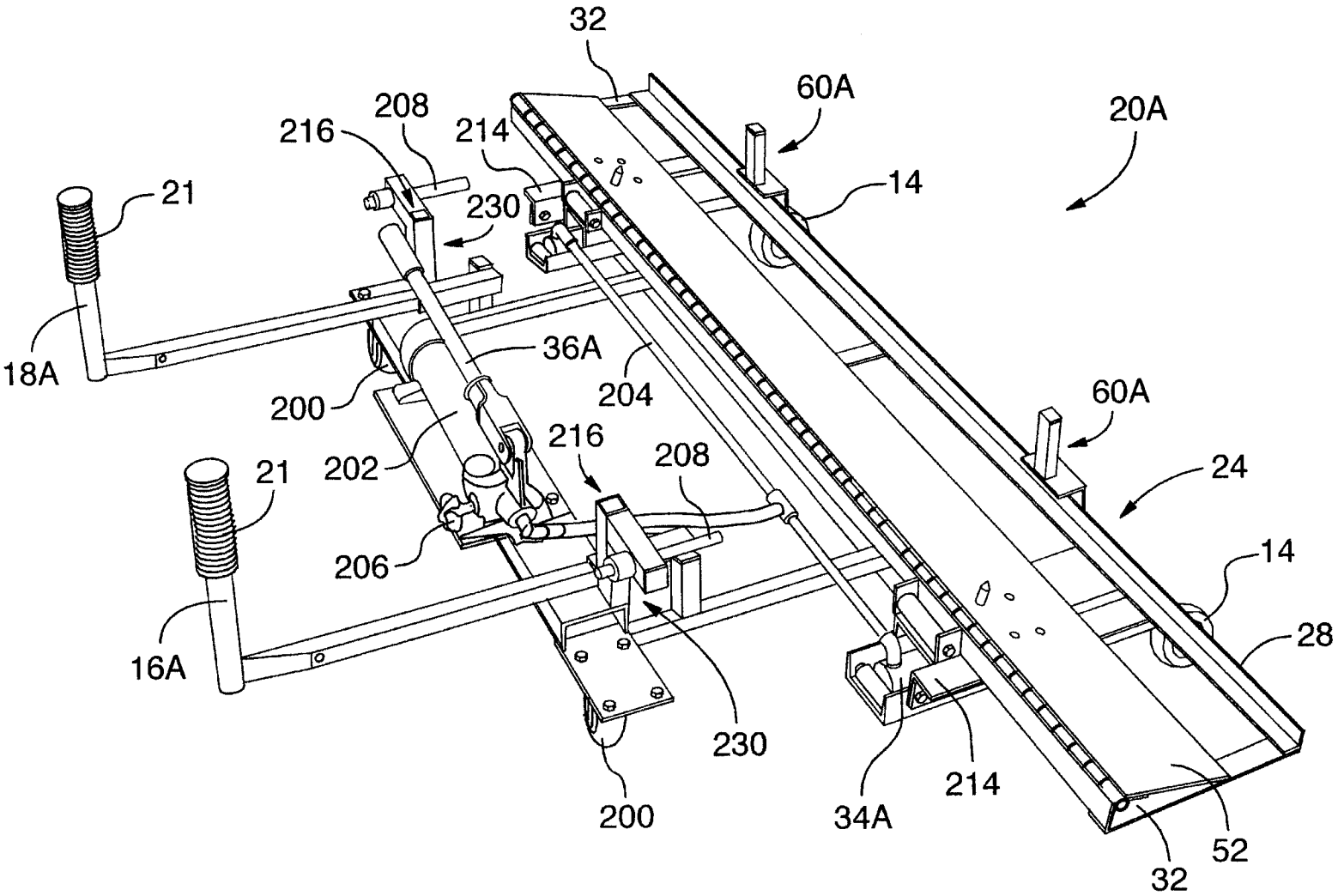
FIG. 12 is rear perspective view of the apparatus of FIG. 10 with the tray shown at its lowered position and the handles disposed at lower operative positions.

A further embodiment of the invention is shown in FIGS. 10-12 and designated with general reference numeral 20A. This embodiment is similar in construction and operation to the embodiment of FIGS. 1-9, and thus, is not described in detail. However, as will be recognized by persons of ordinary skill, this embodiment is different in certain respects from the embodiment of FIGS. 1-9.

Notably, in contrast to the scissor-style jacks previously illustrated, this embodiment comprises a pair of hydraulic jacks 34A, fluidly coupled to one another by a hydraulic line 204 for joint actuation. A hydraulic pump 202 is coupled to fluid line 204. Pump 202 is operable by pump handle 36A for delivering hydraulic fluid to jacks 34A, for extension thereof, to move the tray arrangement 24 to the elevated position, and a valve 206 is provided to permit hydraulic fluid to be released from the jacks 34A, for movement of the tray arrangement 24 to the lowered position. Each jack 34A is pivotably mounted to base frame 12 and to a parallelogram linkage 212,214 which supports tray arrangement 24, such that extension of the jacks 34A cause pivotal movement of the links 212,214 forming the parallelogram linkage 212,214 and movement of the tray arrangement 24 between the lowered and elevated positions.

A further difference resides in the provision of a pair of rear caster wheels 200 upon which the jack mechanism is supported, such that the apparatus 20A rolls on wheels 14,200 in the manner of a cart.

As illustrated in FIG. 10, handles 16A, 18A have a position similar to the position of handles 16, 18 shown in FIG. 3. This represents upper operative positions of the handles 16A, 18A. However, handles 16A, 18A also have storage positions and lower operative positions, shown, respectively, in FIGS. 11 and 12. To provide for this functionality, handles 16A, 18A are defined by L-shaped members, and two pairs of handle-receiving sockets 216 and 210 are provided. When in the upper operative positions, the handles 16A, 18A are fitted into sockets 216 and orientated with grips 21 projecting rearwardly. When in the lower operative positions, handles 16A, 18A are fitted into sockets 210 and orientated with grips 21 projecting upwardly. When in the storage position, the tray arrangement 24 is disposed at its lowered position and the handles 16A, 18A are fitted into sockets 210 and oriented with the grips 21 projecting sideways, away from one another, such that the handles 16A, 18A overly the tray arrangement 24. Pins (not shown) are provided for locking the handles 16A, 18A in the storage, upper operating and lower operation positions, to enhance safety.

The handles 16A, 18A may advantageously be deployed in the lower operative positions if the apparatus 20 is to be used for changing the blade on an ice resurfacing machine having fairly low ground clearance, as it sometimes the case. When in the storage position, the handles 16A, 18A lock the tray arrangement 24 against movement, to permit the apparatus 20 to be pivoted onto its front end, which may be advantageous for storage and transport.

A further difference in the embodiment of FIGS. 10-12 resides in the provision of extendable locating rods 208 which are fitted into bores (not shown) defined in risers 230 in which the sockets 210,216 are defined. The locating rods 208 can be adjusted by a user of the device so as to abut the undercarriage of any given particular ice resurfacing machine when the apparatus is properly positioned for blade exchange, and secured in place with set screws (provided but not identified). Once locating rods 208 are adjusted and suitable markings have been placed onto the ice surfacing machine, suitable positioning of the blade changing device 20A can be obtained simply by aligning the rod 208 ends with the markings.

A further difference resides in the presence of modified stabilizers 60A which have operative positions as shown in FIGS. 10-12, at which same are releasably locked, and which can be released to pivot (not shown) about a hinge defined on their forward, lower edge. When releasably locked at the position of FIGS. 10-12, modified stabilizers 60A function in a manner identical to stabilizers 60 as shown in FIG. 4. When stabilizers 60A are pivoted forwardly (not shown), apparatus 20A may be positioned beneath the ice resurfacing machine for blade exchange in the manner herein described in detail. The stabilizers 60A are spring-loaded, to avoid inadvertent unlocking, again to enhance safety.

A yet further difference resides in the provision of bolts 240 and a pattern of threaded bores 250 provided in flap 52. In use, the bolts 240 are received in respective mounting holes in the blade, to permit the blade to be positioned at a known location relative to the blade changer. This feature, in combination with the locating rods 208, means that a blade can be conveniently disposed at a position beneath the ice resurfacing machine for blade exchange. The pattern of threaded bores 250 reflects the variances in mounting bolt patterns on commonplace ice resurfacing machines, such that the blade changer apparatus can be easily modified for use therewith.

Another exemplary embodiment of the blade changing system for an ice resurfacing machine is illustrated in FIGS. 21 to 35 and will be seen to comprise a blade 201, a sheath 300, a locating pin 400 and a blade changing apparatus 110. The blade changing system is used to mount the blade 201 to the ice resurfacing machine, specifically, to the blade receiver 160 of the ice resurfacing machine. Receiver 160 has a number of mounting holes defined therein which are used for mounting the blade 201.

Figure 21:
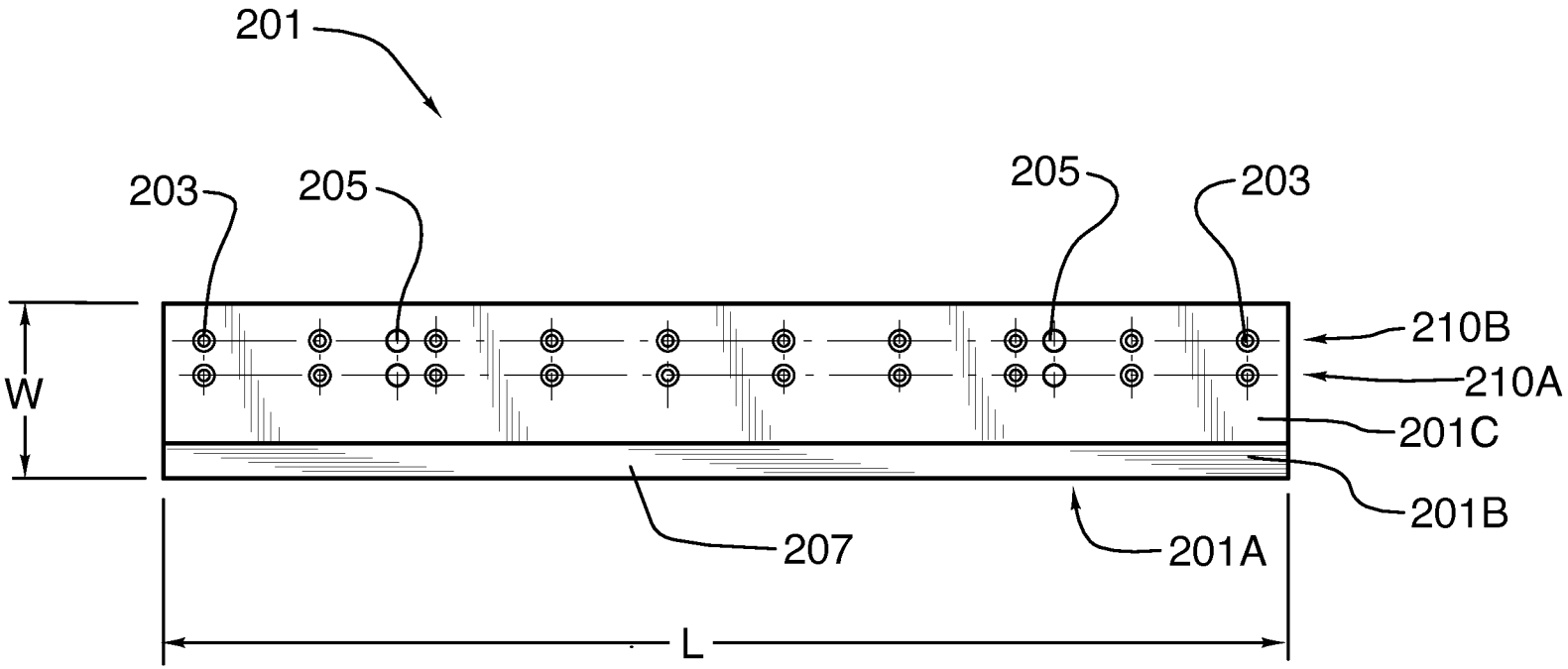
FIG. 21 is a top view of a blade constructed according to another exemplary embodiment of the invention.

The blade 201 will be seen in FIG. 21 to be constructed of stainless steel, to be elongate in shape, with its length L substantially exceeding its width W, and to have a plurality of threaded sockets 203 and a plurality of indexing holes 205. The threaded sockets 203 are arranged into two rows 210A and 210B which are spaced along the width of the blade 201. The threaded sockets 203 of each row 210A and 210B are provided one for each of the mounting holes of the blade receiver 160. As shown, each of row 210A and 210B consists of ten (10) threaded sockets 203 and two (2) indexing holes 205. The threaded sockets 203 are threaded while the indexing holes 205 are smooth. The blade 201 also has a cutting edge 207 which is defined by the edge between the bottom surface 201A and the angled surface 201B of the blade 201.

Figure 22:
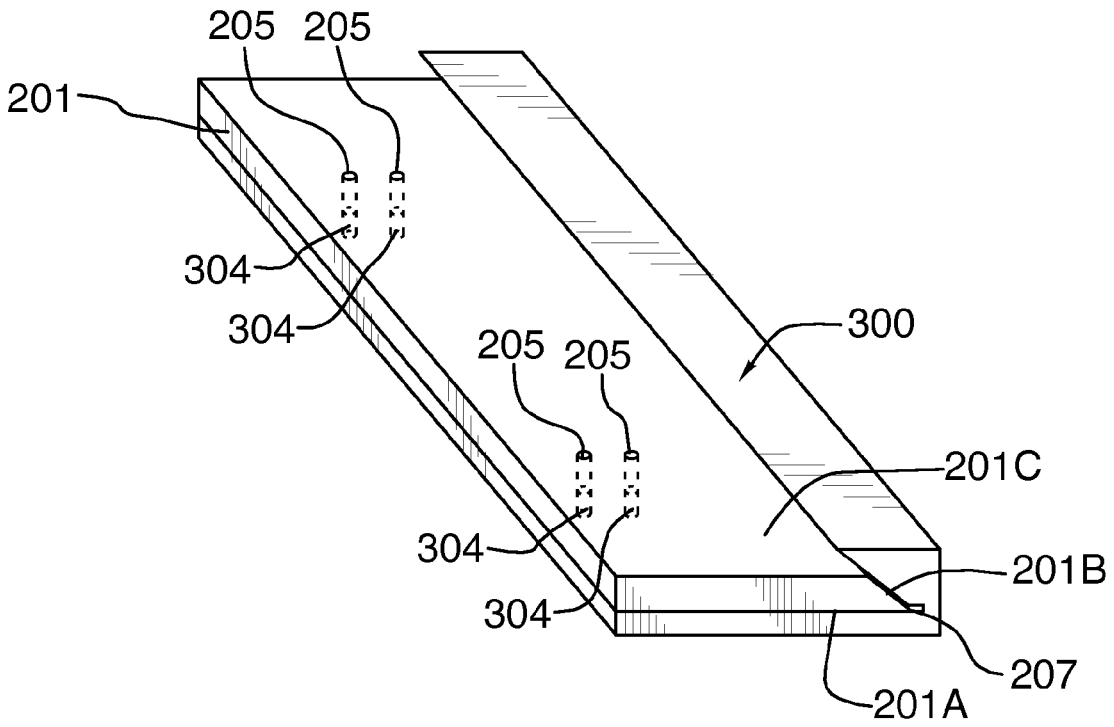
FIG. 22 is a perspective view of a sheath constructed according to the other exemplary embodiment of the invention, secured to the blade of FIG. 21.

The sheath 300 is shown in FIG. 22 and will be seen to be constructed of wood and have a plurality of indexing apertures 304, shown in phantom outline, which extend through the sheath 300. For clarity, threaded sockets are not shown in FIG. 22. The sheath 300 is coupled to the blade 201 of FIG. 21 to form a blade/sheath combination 200/300. In the blade/sheath combination 201/300, the sheath 300 extends around the cutting edge 207 from the bottom surface 201A to the angled surface 206B, but not the top surface 201C of the blade 201. In this way, the sheath 300 acts as a guard for the blade 201 by covering the cutting edge 207. As shown, there are four (4) indexing apertures 304 which align with the four (4) indexing holes 205 when the blade 201 is coupled to the sheath 300.

Figure 23:
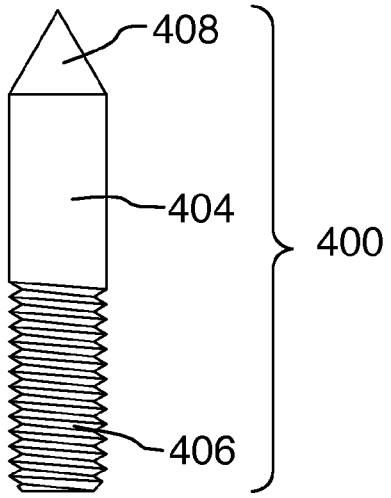
FIG. 23 is a side view of the locating pin constructed according to the exemplary embodiment of the invention.

The locating pin 400 is shown in FIG. 23 and will be seen to have a smooth end 404 with a pointed tip 408 and a threaded end 406. The threaded end 406 is sized to engage with any of the threaded sockets 203 of the blade 200. The smooth end 404 is sized to be snugly received by any of the mounting holes of the blade receiver 160.

Figure 24:
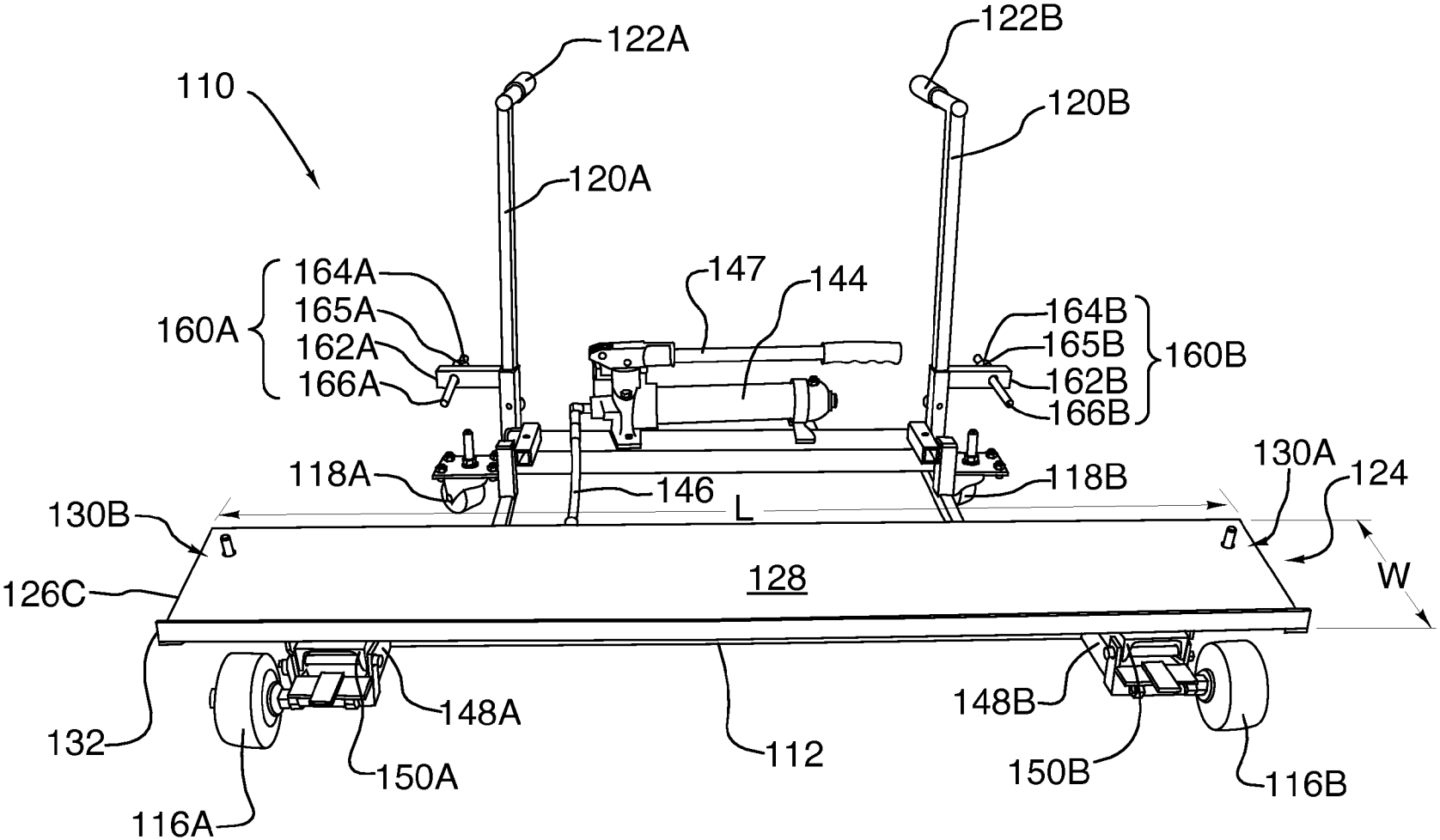
FIG. 24 is a front perspective view of a blade changing apparatus constructed according to the other exemplary embodiment of the invention.
Figure 25:
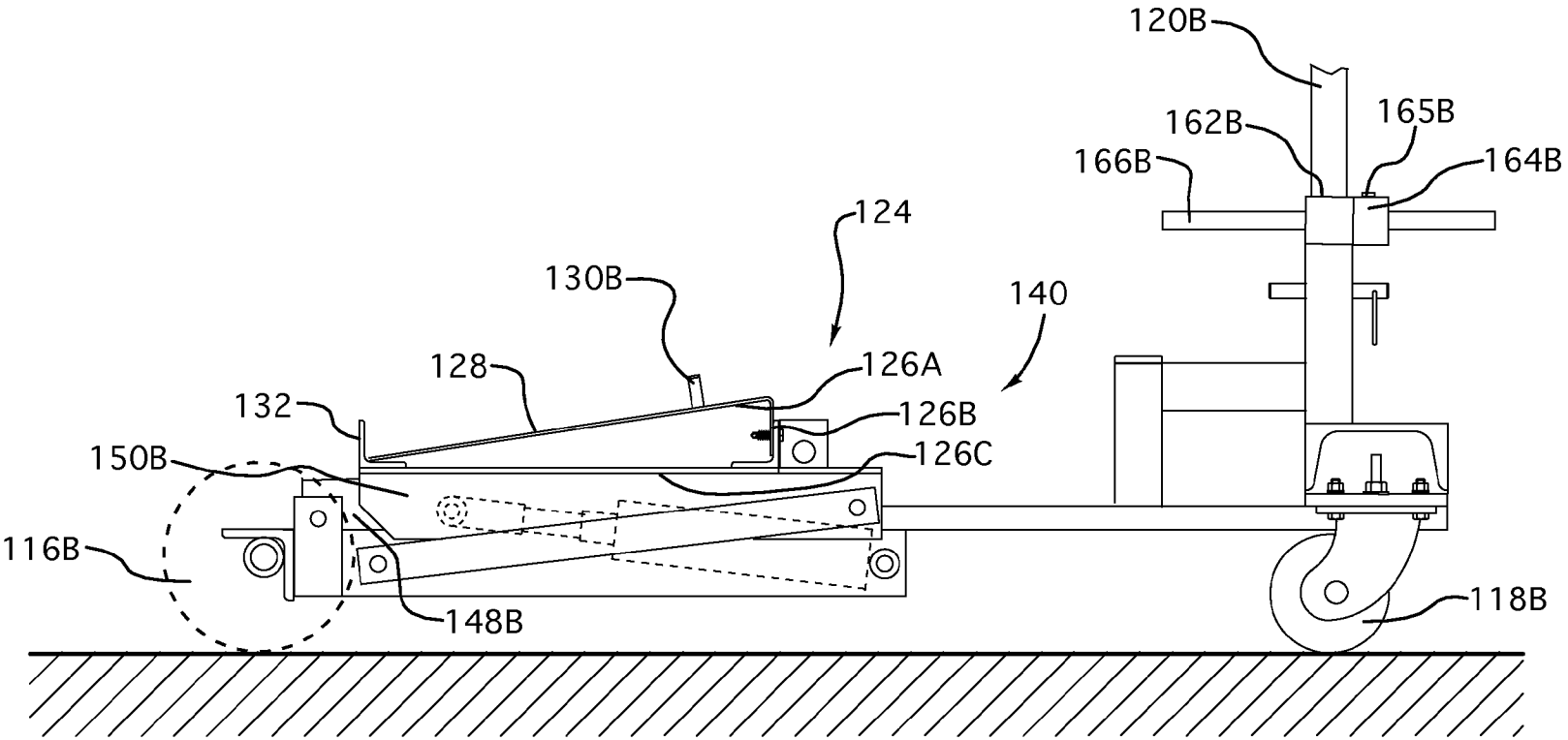
FIG. 25 is a side view of the blade changing apparatus of FIG. 24.
Figure 26A:
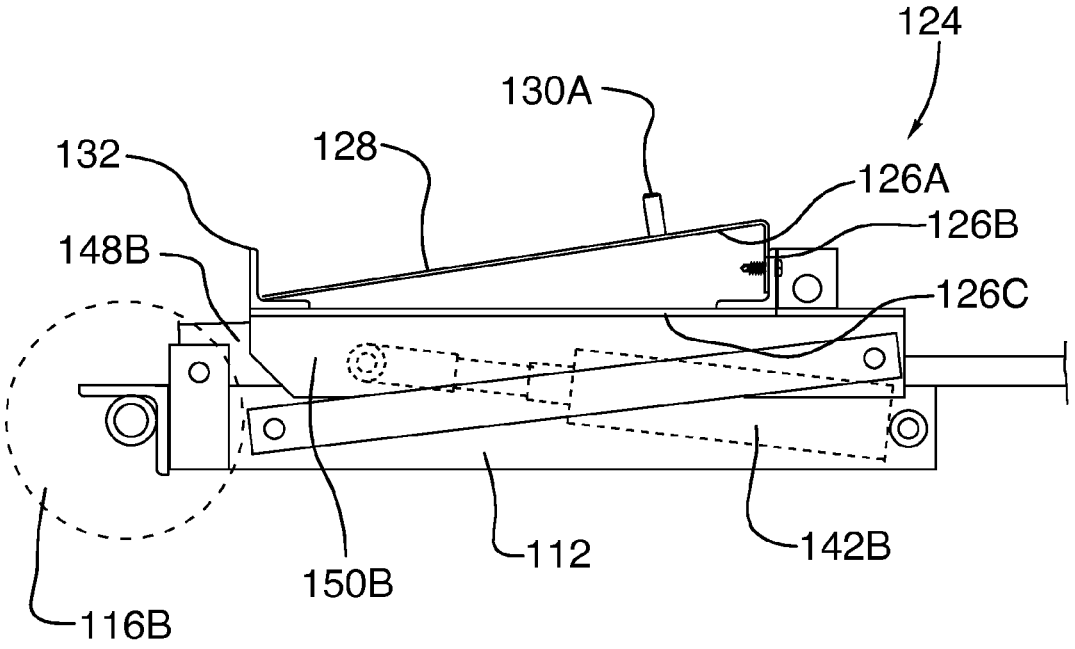
FIG. 26A is an enlarged, side view of the blade changing apparatus of FIG. 24 in the collapsed position.
Figure 26B:
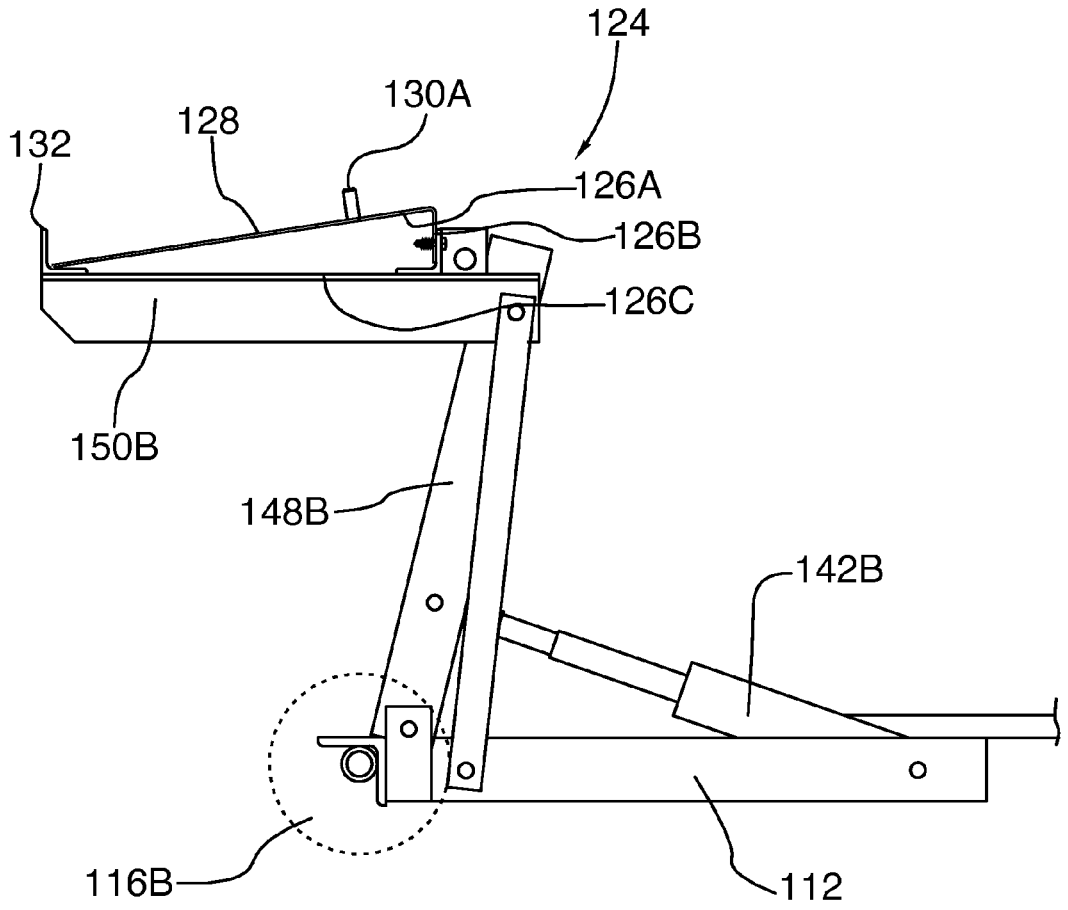
FIG. 26B is an enlarged, side view of the blade changing apparatus of FIG. 24 in the expanded position.

The blade changing apparatus 110 is shown in FIGS. 24 and 25 and will be seen to comprise a base frame 112, a tray arrangement 124, indicators 160A and 160B, and a jack mechanism.

The base frame 112 has fixed wheels 116A and 116B, castor wheels 118A and 118B, and bent handle members 120A and 120B which are shown in FIG. 24. The fixed wheels 116A and 116B are spaced at a forward end of the base frame 112 and the castor wheels 118A and 118B are spaced at a rearward end of the base frame 112. The bent handle members 120A and 120B extend upwardly and rearwardly from the second end of the base frame 112. The ends of the bent handle members 120A and 120B have rubber hand grips 122A and 122B. It will therefore be appreciated that the frame 112 may be rolled along a floor in the manner of a cart by pushing the frame 112 at the handle members 120A and 120B.

The tray arrangement 124 has an upper surface 128, indexing pins 130A and 130B, and edge member 132. The tray arrangement 124 is constructed from elongate steel sheets 126A, 126B and 126C which are shown in FIG. 25. The ends of sheets 126A, 126B and 126C are rigidly connected to form the right-angled triangle structure of tray arrangement 124. In this structure, sheet 126B and 126C form the catheti of the triangle and sheet 126A forms the hypotenuse of the triangle. The upper surface 128 is that of sheet 126A with the upper surface 128 being presented at an acute angle $\alpha$ to the floor. The pins 130A and 130B are spaced from each other along the length of the upper surface 128 at a distance which is the same as the spacing of the indexing holes 205 of each of the rows 210A and 201B and are each sized to be snugly received by one of the indexing holes 205. The edge member 132 extends along the leading edge of the upper surface 128 and projects in a direction substantially normal to the upper surface 128.

The indicators 160A and 160B comprise first support members 162A and 162B, second support members 164A and 164B, set screws 165A and 165B, and studs 166A and 166B, which are shown in both of FIGS. 24 and 25. The first support members 162A and 162B extend outwardly from the handle members 120A and 120B respectively and the second support members 164A and 164B extend rearwardly from the first support members 162A and 162B respectively.

A smooth bore extends through each of the first support members 162A and 162B and second support members 164A and 164B and a threaded bore extends through each of the second support members 164A and 164B from the outer- to the inner-diameter thereof. The set screws 165A and 165B each engage one of the threaded bores. The studs 166A and 166B are each received by one of the smooth bores and, when so received, extend forwardly past the first support members 162A and 162B and rearwardly past the second support members 164A and 164B.

The jack mechanism comprises mounting brackets 150A and 150B, pivotable arm pairs 148A and 148B, and a hydraulic system.

The mounting brackets 150A and 150B are each secured with fasteners to opposite ends of the tray arrangement 124 and allow the arm pairs 148A and 148B to connect to the tray arrangement 124.

The arm pairs 148A and 148B link the mounting brackets 150A and 150B respectively to the base frame 112 in a manner similar to a floor jack. Being linked in this manner, the arm pairs 148A and 148B are movable between collapsed and expanded positions while substantially maintaining the rotational orientation of the mounting brackets 150A and 150B and thus the tray arrangement 124 to which brackets 150A and 150B are connected. Therefore, in this way, the upper surface 128 of the tray arrangement 124 presents at substantially the same acute angle in the collapsed position as in the expanded position. The arm pairs 148A and 148B in the expanded and collapsed position respectively are shown up-close in FIGS. 26A and 26B. The collapsed position is characterized by arm pairs 148A and 148B having a high angle of incidence relative to the base frame 112 and the tray arrangement 124. By contrast, the expanded position is characterized by the arm pairs 148A and 148B having a low angle of incidence relative to the base frame 112 and the tray arrangement 124.

The hydraulic system comprises a pair of cooperating cylinders 142A and 142B and a pumping cylinder 144 which are connected via a flexible hose 146. The cooperating cylinders 142A and 142B have a fully extended configuration and fully retracted configuration. The cooperating cylinders 142A and 142B each extend between the arm pairs 148A and 148B respectively and the base frame 112 such that when in the fully extended configuration, the arm pairs 148A and 148B will be in the expanded position, and when in the fully retracted configuration, the arm pairs 148A and 148B will be in the collapsed position. The pumping cylinder 144 is used to drive the cooperating cylinders 142A and 142B from the fully retracted configuration to the fully extended configuration which, in turn, moves the arm pairs 148A and 148B from the collapsed position to the expanded position.

The relationship between the various parts and the function of the various aspects of the blade changing system will now be described.

The threaded sockets 203 are used to mount the blade 201 to the blade receiver 160. The blade 201 has an operative position wherein the blade 201 can be mounted to the blade receiver 160. The operative position is a position in which the threaded sockets 203 of either one of rows 210A or 210B align with the mounting holes of the blade receiver 160. In accordance with conventional practice, the first row 210A is used when the blade 201 is more than 4" in width and the second row 210B is used when the blade 201 is less than 4" in width, but these are merely guidelines and strict compliance is not necessary.

The indexing holes 205 are used to index the blade/sheath combination 201/300 to the blade changing apparatus 110. The blade/sheath combination 201/300 is indexed to the tray arrangement 124 when either of the first row 210A or the second row 210E of indexing holes 205 are snugly received by the locating pins 130A and 130B of the tray arrangement 124.

The locating pin 400 is used to index the blade 201 to the blade receiver 160 in the operative position. The locating pin 400 will index the blade 201 to the blade receiver 160 when the first end 406 of the pin 400 engages one of the threaded sockets 203 and the second end 404 is received by the mounting hole of the blade receiver 160 for which that threaded socket 203 was provided.

The blade changing apparatus 110 has number of functions. One function is to manoeuvre the blade 201 to a loading position under the blade receiver 160. Another function is to raise the blade 201 to the blade receiver 160 for mounting thereto. Therefore, in accordance with the former function, the tray arrangement 124 is capable of being lowered enough in the collapsed position to enable the blade 201 indexed to the tray arrangement 124 to be manoeuvred under the blade receiver 160. In accordance with the latter function, the tray arrangement 124 is capable of being raised enough in the expanded position to enable the blade 201 indexed to the tray arrangement 124 to be mounted to the blade receiver 160.

The procedure for mounting a blade using the blade changing system according to the exemplary embodiment will now be described with general reference to FIGS. 27 to 32.

Prior to the use of the blade changing system, the blade changing apparatus 110 is calibrated for the particular ice resurfacing machine for which it is to be used. To calibrate the blade changing apparatus 110, with the blade 201 already mounted to the blade receiver 160 of the ice resurfacing machine, the blade changing apparatus 110 is manoeuvred such that the tray arrangement 124 is under the blade receiver 160. In this position, the indicators 160A and 160B extending from the bent handle members 120A and 120B will be in proximity to an external surface of the blade receiver 160. The tray arrangement 124 is then raised until the indexing pins 130A and 130B are almost touching the blade 201. The blade changing apparatus 110 is further manoeuvred until the indexing pins 130A and 130B are positioned directly under the indexing holes 205 that belong to the row of threaded sockets 203 being used to mount the blade 201 to the blade receiver 160. The tray arrangement 124 is further raised to the expanded position so that the indexing pins 130A and 130B are each received by the indexing holes 205 under which they were positioned.

Then, with the indexing pins 130A and 130B so received, the studs 166A and 166B are advanced forwardly in their respective smooth bores until they contact the external surface of the blade receiver 160 at which point the set screws 165A and 165B are advanced in their respective threaded bores to secure the studs 166A and 166B in place in their respective smooth bores. Thereafter, with the studs 166A and 166B so secured, the location of each of the studs 166A and 166B is marked on the blade receiver 160, which will conclude the calibration. The blade changing apparatus 110 can thus be removed from its position under the machine until it is ready to be used.

To use the blade changing system, if not already in the collapsed position, the tray arrangement 124 is first lowered into the collapsed position. The blade/sheath combination 201/300 is then placed on the upper surface 128 with either of the first row 210A or the second row 210B of indexing holes 205 snugly received by the locating pins 130A and 130B. This will index the blade/sheath combination 201/300 to the tray arrangement 124. The threaded end 406 of the locating pin 400 is then threaded into any one of the threaded sockets 203.

Next, with the blade/sheath combination 201/300 indexed to the tray arrangement 124, the blade changing apparatus 110 is manoeuvred so that the studs 166A and 166B contact the outer surface of the blade receiver 160 at their previously marked locations which will, in turn, position the blade changing apparatus 110 at the loading position. The need to position the studs 166A and 166B precisely at their previously marked locations is avoided by the shape of the locating pin 400 and the mounting hole of the blade receiver 160, which allows the locating pin 400 to slide into that mounting hole, so long as blade changing apparatus 110 is within a predetermined range of positions.

It will be appreciated that the predetermined range of positions will depend on the shape of both the locating pin 400 and the mounting hole, their shapes in the exemplary embodiment being pointed and chamfered respectively.

Then, with the tray arrangement 124 either at the loading position or within the predetermined range of positions, the tray arrangement 124 is raised into the expanded position. If the blade changing apparatus 110 is positioned precisely at the loading position, raising the tray arrangement 124 to the expanded position will cause the locating pin 400, engaging one of the threaded sockets 203, to be immediately received by the mounting hole for which that threaded socket 203 is provided. Otherwise, if the blade changing apparatus 110 is positioned within a predetermined range of positions including the loading position, but apart from the loading position, raising the tray arrangement 124 to the expanded position will instead cause the locating pin 400, engaging one of the threaded sockets 203, to slide into the mounting hole for which that threaded socket 203 is provided through the cooperative engagement of the locating pin 400 and the mounting hole. The cooperative engagement of the locating pin 400 and the mounting hole will, in turn, urge the blade changing apparatus 110 into the loading position.

Thereafter, with the blade 201 indexed to the blade receiver 160, from a position above the receiver, threaded fasteners are passed through the mounting holes and threaded into each of the threaded sockets 203 in order to secure the blade 201 to the blade receiver 160. In respect of the threaded socket 203 into which the locating pin 400 is threaded, the locating pin 400 is removed and replaced with a threaded fastener. While the locating pin 400 may be immediately removed, it is preferable to secure several threaded fasteners to the other threaded sockets 203 before doing so.

Next, with the blade 201 mounted to the blade receiver 160, tray arrangement 124 is lowered to the collapsed position in which the blade changing apparatus can be manoeuvred to a position removed from the ice resurfacing machine.

Figure 27:
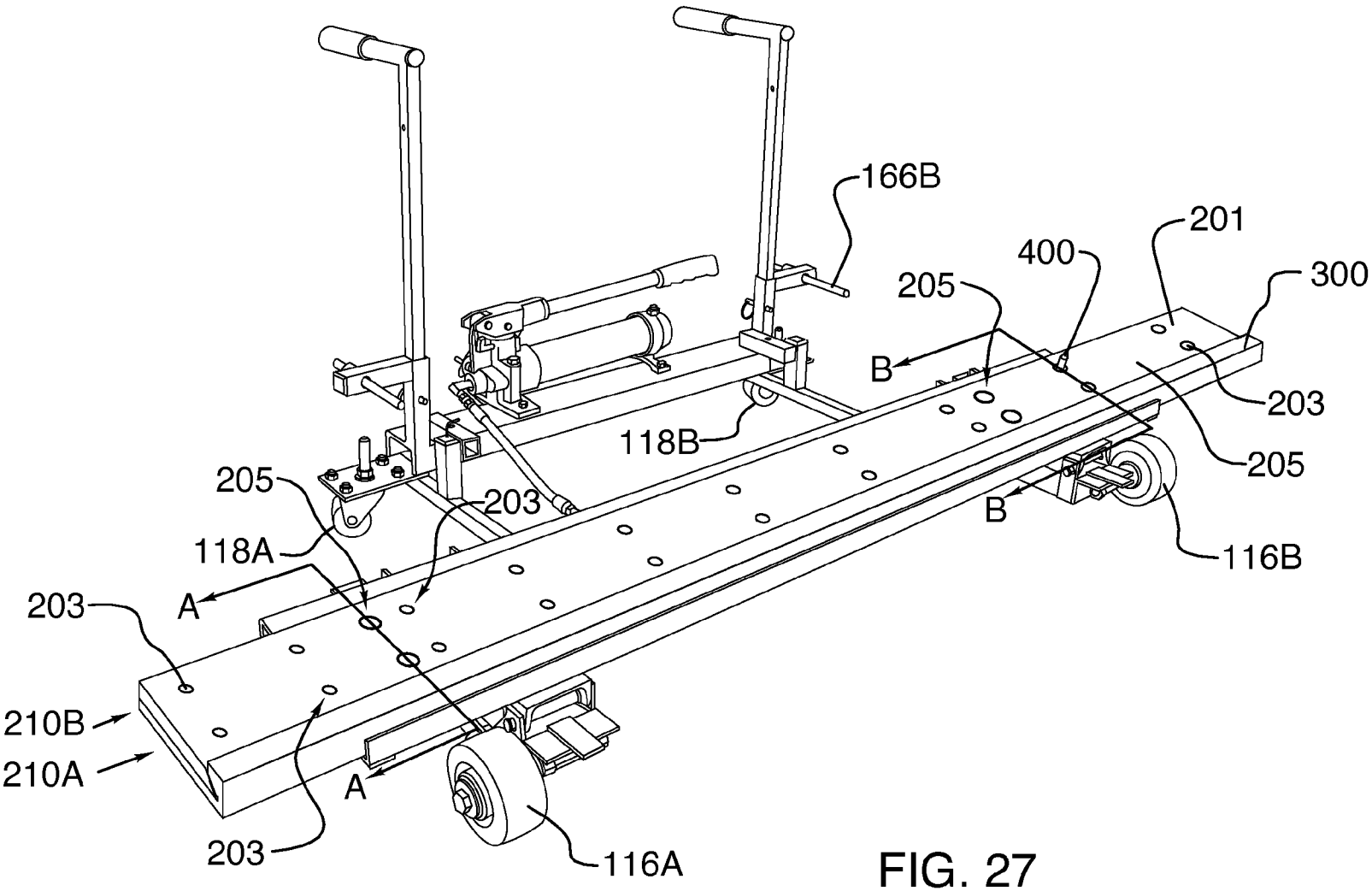
FIG. 27 is a perspective view of the blade and sheath of FIG. 22 indexed to the blade changing apparatus of FIG. 24.
Figure 28A:
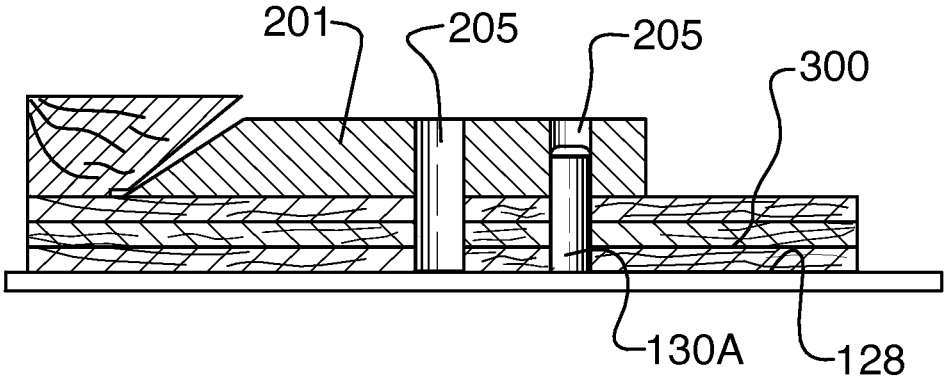
FIG. 28A is a cutaway view along the line A-A of FIG. 27.
Figure 28B:
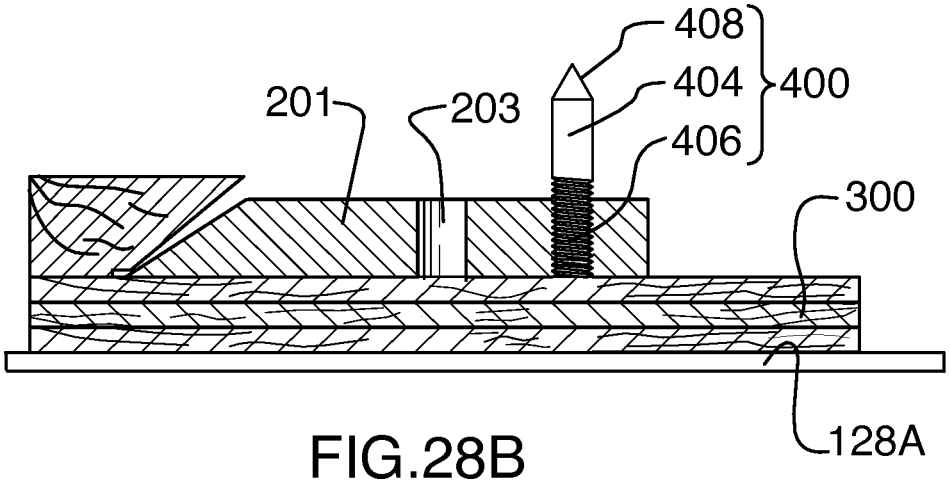
FIG. 28B is a cutaway view along the line B-B of FIG. 27.

The blade/sheath combination 201/300 is shown indexed to the blade changing apparatus 110 in FIG. 27. A cutaway view of the threaded sockets 203 and indexing holes 205 of FIG. 27 is shown in FIGS. 28B and 28A respectively. The indexing pin 130A is shown in FIG. 28A to be received by one of the indexing holes 205 of the row 210B.

The locating pin 400 is shown in FIG. 28B to have its threaded end 406 engaging one of the threaded sockets 204 of the row 210B and its smooth end 404 projecting from the exposed surface of the blade 201.

Figure 29:
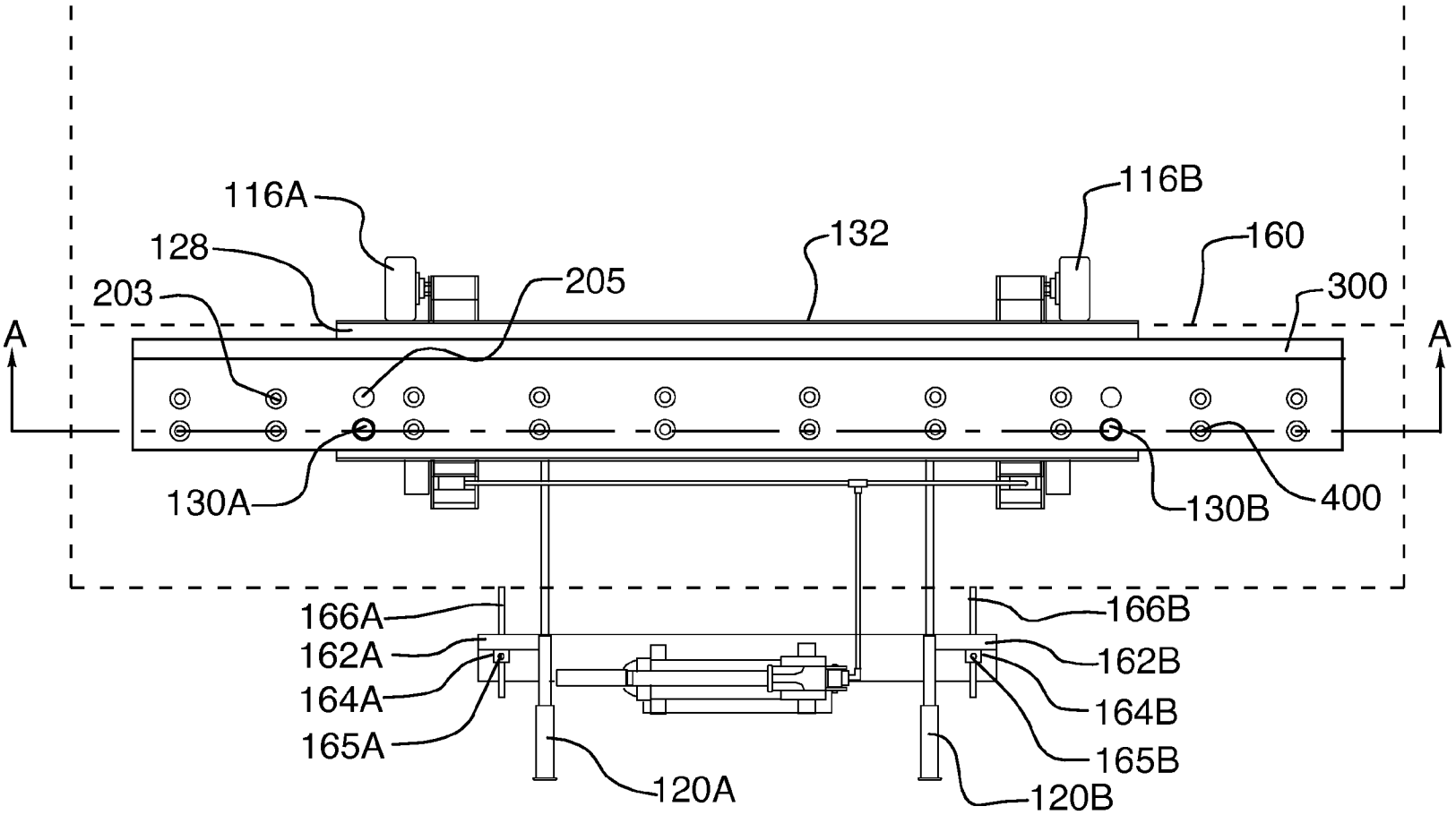
FIG. 29 is a top view of the blade and sheath of FIG. 22 indexed to the blade changing apparatus of FIG. 24 which is underneath a blade receiver, the blade receiver being shown in phantom outline.
Figure 30:
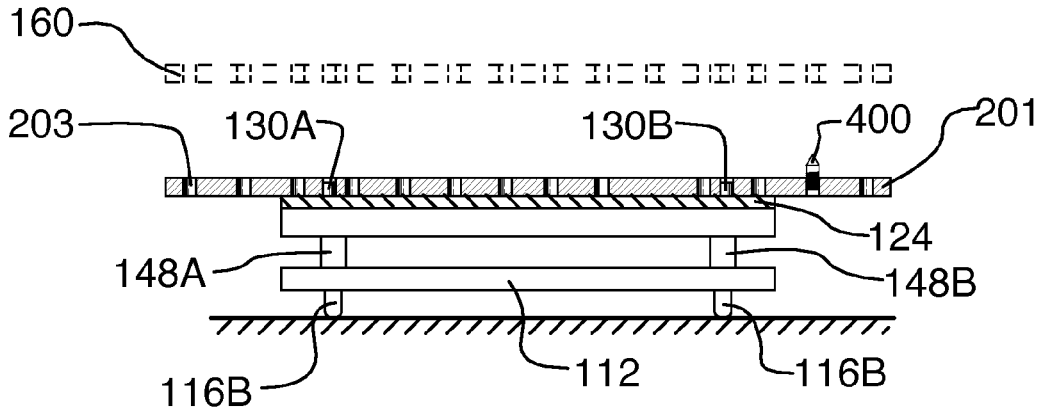
FIG. 30 is a schematic view along the line A-A of FIG. 29.
Figure 31:
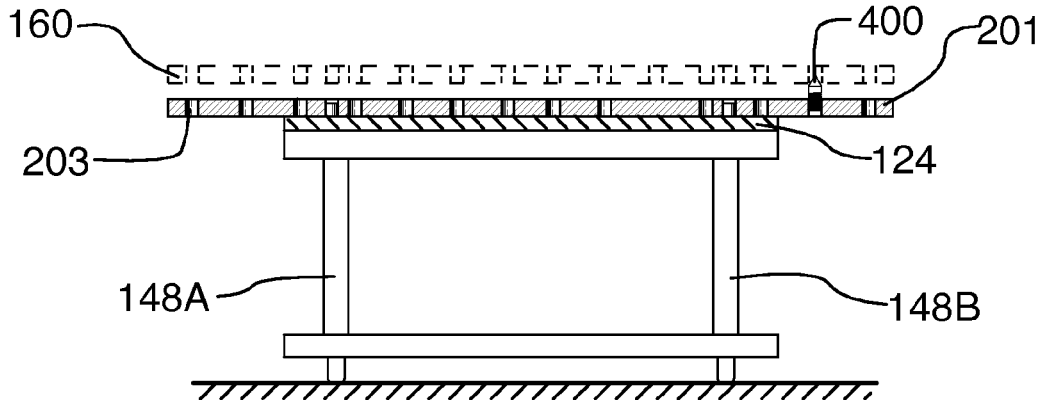
FIG. 31 is the view of FIG. 30 with the blade changing apparatus shown at a position immediately before the expanded position.
Figure 32:
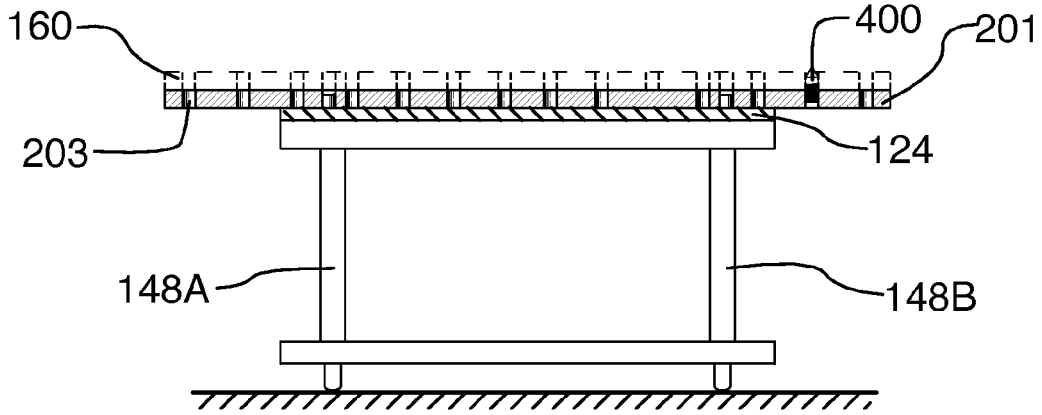
FIG. 32 is the view of FIG. 30 with the blade changing apparatus shown at the expanded position, the position of the blade changing apparatus of FIG. 31 being shown in phantom outline.
Figure 33A:
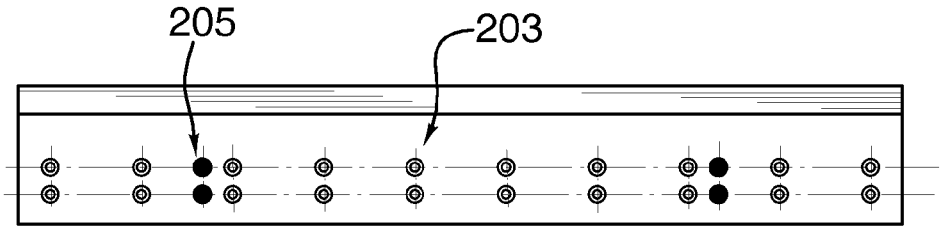
FIGS. 33A-33D are top views of several variants of the blade of FIG. 21.
Figure 33B:
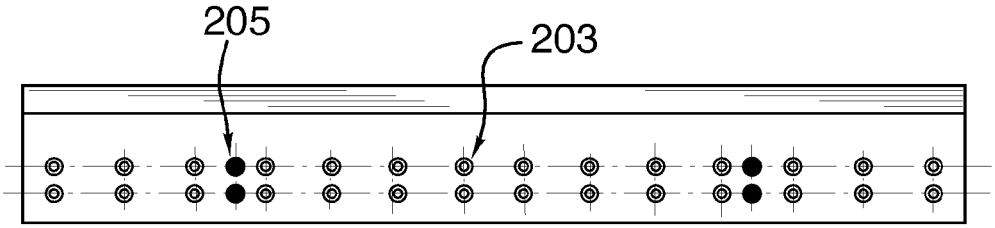
Figure 33C:
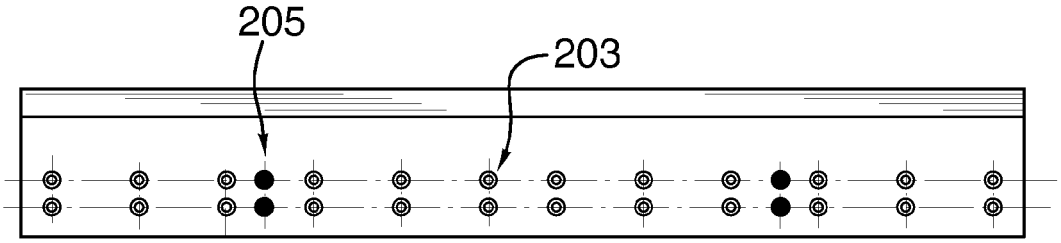
Figure 33D:
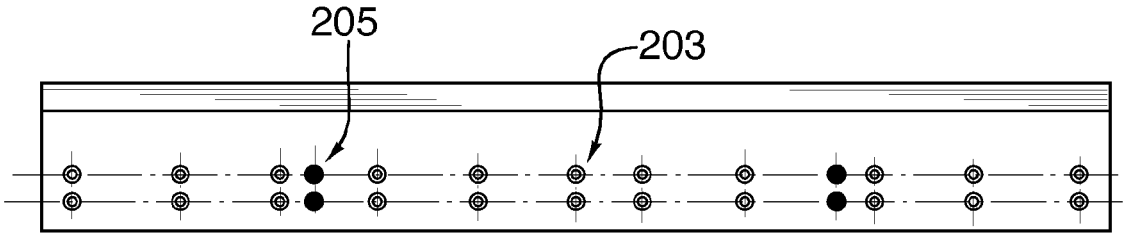
Figure 34:
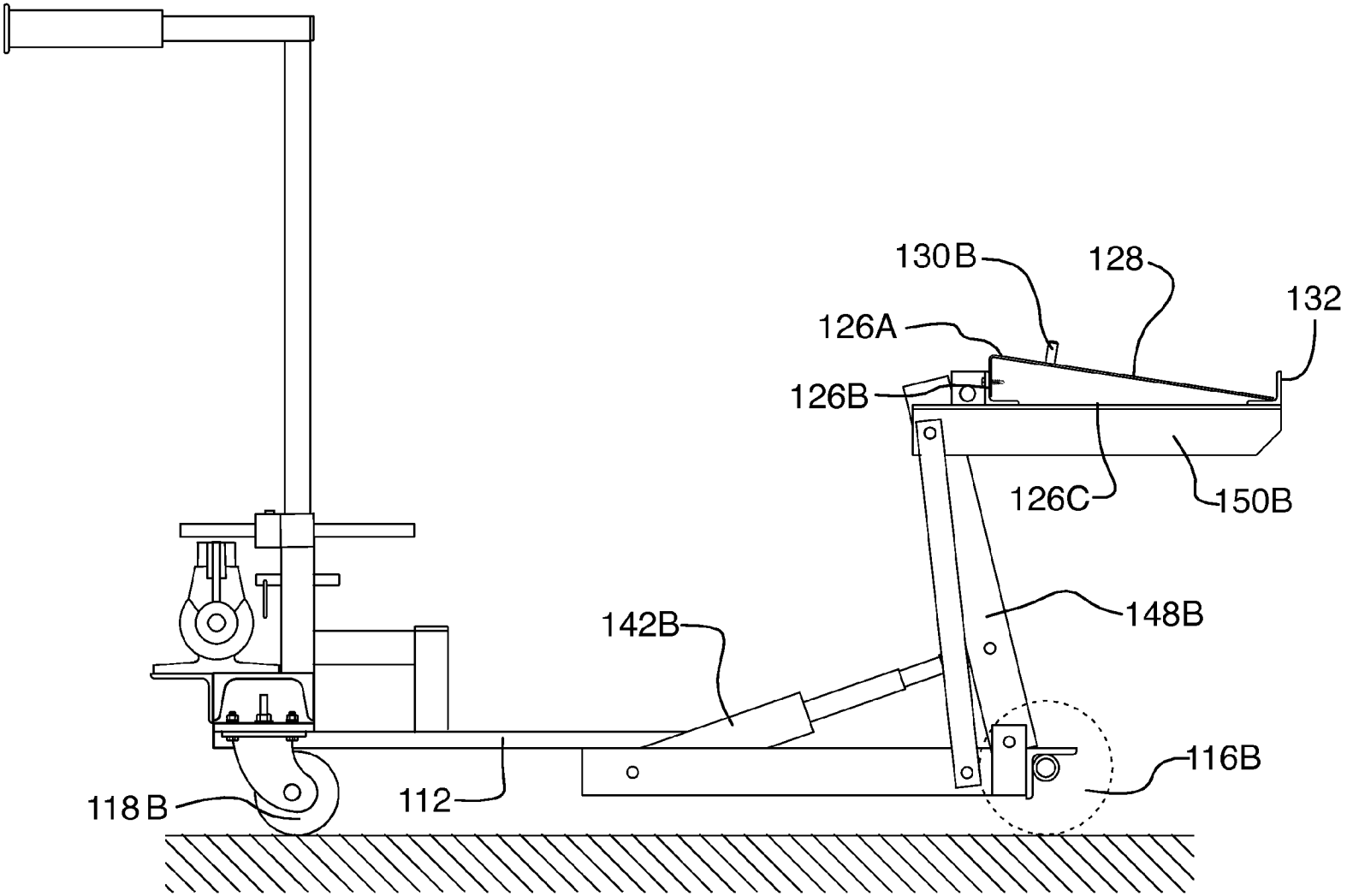
Figure 35:
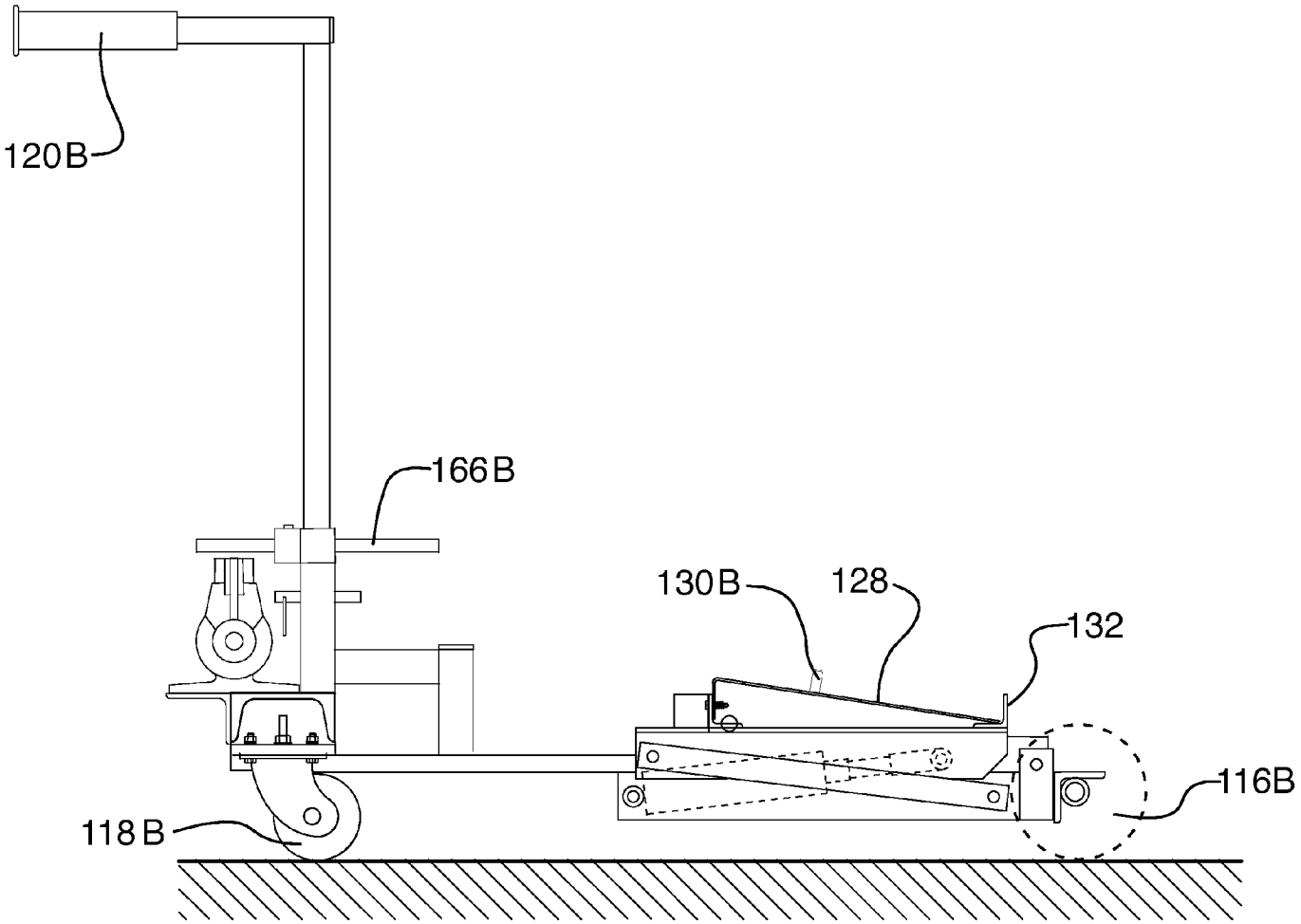

The interaction of the locating pin 400 and the blade receiver 160 is shown in FIGS. 29-32. In FIGS. 29 and 30, the blade changing apparatus 110 is shown in the loading position underneath the blade receiver 160. Indicators 160A, 160B are shown in FIG. 29 to be in contact with the blade receiver 160 at their previously marked locations. In FIG. 31, the locating pin 400 is shown almost touching the inside of a mounting hole, while in FIG. 32, the locating pin 400 is shown inside the mounting hole and the blade changing apparatus 110 is shown shifted from its original position.

It will be apparent that the above procedure in reverse can be used to remove a blade from the blade receiver; however, when doing so, use of the locating pin is not necessary.

While but two exemplary embodiments of the blade changing system and two exemplary uses thereof have been herein shown and described, it will be understood that various changes may be made.

As one example, the number and location of the mounting holes can vary depending on the ice resurfacing machine into which the blade is intended to be mounted. A blade compatible with, for example, a ZAMBONI Model 525 ice resurfacing machine will not be compatible with an OLYMPIA or an ICECAT ice resurfacing machine. FIGS. 33A to 33D show several blade variants, each compatible with a different ice resurfacing machine. Specifically, the blades illustrated in FIGS. 33A to 33D are compatible with, respectively, a ZAMBONI™ Model 525, an OLYMPIA™ Millennium (80"), an OLYMPIA™ Millennium (84"), and an ICECAT™ PRO220.

As another example, the number and location of the indexing holes can vary. However, by spacing the indexing holes of each row to either side of a centreline of the blade at 48" from each other, minimal interference with mounting holes can be achieved where blades for several different types of known ice resurfacing machines are used with the blade changing system.

Further, whereas the illustrated sheath has four indexing apertures, it will be appreciated that this is not strictly necessary, and that two indexing apertures could readily be utilized.

As yet another example, where indexing pins are described for use in indexing the blade to the blade changing apparatus, other methods could be used to index the blade such as grooves, protuberances or the like. Further, whereas the illustrated indexing pin has a simple tapered end, the end could be provided, for example, with a slot, to facilitate installation and removal of the pin.

As yet another example, where the tray arrangement is described as receiving a blade/sheath combination, the tray could simply receive the blade. However, by holding both the blade and sheath together in the blade/sheath combination, the need to remove the blade from the sheath prior to it being mounted on the ice resurfacing machine can be avoided, thereby mitigating the risk associated with handling an unsheathed blade. Also, whereas the blade in indicated to be stainless steel, this is not strictly necessary, and blades of carbon steel or inlaid steel can be utilized.

As yet another example, where the jack mechanism is described as arranged similar to a floor jack, a greater or lesser number of jacks, and jacks of different types, such as screw jacks, could be substituted.

As yet another example, where the blade changing apparatus is described as being provided with wheels for movement in the manner of a shopping cart, other arrangements could be contemplated.

As yet another example, where the tray arrangement is described as a metal plate, it could take other forms, such as a metal framework of bars or the like.

As yet another example, where only a single locating pin is described for use in indexing the blade to the blade receiver, a plurality of locating pins could be used.

Accordingly, it should be understood that the invention is to be limited only by the claims appended hereto, purposively construed.

What is claimed is:

1. A blade changing system for an ice resurfacing machine having a blade receiver including one or more mounting holes, the system comprising:

a blade having a length, a width, one or more indexing holes defined therein, one or more threaded sockets defined therein and provided one for each of the mounting holes, and a cutting edge extending the length of the blade, the blade having an operative position whereat each threaded socket is substantially contiguous with the mounting hole provided, thereby permitting the blade to be mounted to the machine by threaded bolts;

provided for each of one or more of the threaded sockets, a locating pin having a threaded first end and a second end, the first end engaging in use said each threaded socket and the second end being received in use by the mounting hole for which said each threaded socket was provided to index the blade to the blade receiver at the operative position;

a blade changing apparatus having a loading position, the apparatus including: a tray arrangement adapted to operatively hold the blade and having one or more indexing pins provided one for each of the one or more indexing holes, each indexing pin being received in use by the indexing hole provided to index the blade to the tray arrangement when held thereby; and a jack mechanism adapted to move the tray arrangement between a first position and a second position, the first position and second position of the tray arrangement being respectively associated with a first configuration and a second configuration of the jack mechanism;

wherein in the first configuration, the apparatus is movable into the loading position from a position removed from the loading position, and in the second configuration, when the blade is indexed to the tray arrangement and the apparatus is in the loading position, the locating pins are received by the mounting holes and the blade is at the operative position: and further comprising a sheath to which the blade is coupled for handling having one or more indexing apertures defined therethrough, the indexing apertures being provided one for each of the indexing holes and each of the indexing apertures aligning with the indexing hole for which it is provided, wherein the tray arrangement is further adapted to operatively hold the blade when the sheath is coupled thereto.

2. The blade changing system of claim 1, wherein the locating pins and the mounting holes are shaped such that when the blade changing apparatus is apart from the loading position, but within a predetermined range of positions including the loading position, and the jack mechanism is in the first configuration, moving the jack mechanism to the second configuration causes each locating pin to slide into the mounting hole provided for the threaded socket in which said each locating pin is engaged, thereby urging the blade to the operative position and the blade changing apparatus to the loading position.

3. The blade changing system of claim 1, wherein the shape of the second end of the locating pin is selected from the group consisting of: pointed, rounded, spherical, beveled or chamfered.

4. The blade changing system of claim 1, wherein the mounting holes are chamfered.

5. The blade changing system of claim 1, wherein:

the tray arrangement includes an elongate upper surface having a length, a width, and opposite ends between which the upper surface extends in the lengthwise direction; and the blade is held on the upper surface such that the length and width of the blade extend in the lengthwise and widthwise direction respectively of the upper surface.

6. The blade changing system of claim 5, wherein the width of the upper surface is disposed at an acute angle to a horizontal surface on which the blade apparatus rests.

7. The blade changing system of claim 6, wherein the one or more indexing pins comprises two indexing pins which project from the upper surface in a direction substantially normal thereto.

8. The blade changing system of claim 1, wherein the blade changing apparatus further includes a frame to which the jack mechanism is mounted, the frame having a plurality of wheels for rolling movement.

9. The blade changing system of claim 1, wherein the jack mechanism comprises a first jack arrangement and a second jack arrangement both of which are configured in a manner similar to a floor jack and connected to the tray arrangement.

10. The blade changing system of claim 1, wherein the blade changing apparatus is under the blade receiver in the loading position.

11. An improved blade for an ice resurfacing machine, the blade being of the type having a length and a width, the blade bisected lengthwise into two equal halves by a reference line, the blade including:

a cutting edge extending the length of the blade; and a plurality of threaded sockets arranged for compatibility with the ice resurfacing machine;

wherein the improvement comprises:

two pairs of indexing holes arranged on either side of the reference line, the holes of the hole pairs being spaced from each other along the width of the blade and the hole pairs being spaced from each other along the length of the blade at a distance of about 48"; and further comprising a sheath for use with the blade, the sheath having one or more indexing apertures extending therethrough, the indexing apertures being provided one for each of the indexing holes and each of the indexing apertures aligning with the indexing hole for which it is provided.

12. The blade of claim 11, wherein the threaded sockets are compatible with a Zamboni™ Model 525.

13. The blade of claim 11, wherein the threaded sockets are compatible with an Olympia™ Millennium (80").

14. The blade of claim 11, wherein the threaded sockets are compatible with an Olympia™ Millennium (84").

15. The blade of claim 11, wherein the threaded sockets are compatible with an ICECAT™ PRO220.

16. The blade changing apparatus of claim 1.

* * * * *